US006142597A

United States Patent [19]

Kagami

[11] Patent Number: 6,142,597

[45] Date of Patent: Nov. 7, 2000

[54] PRINTER DEVICE

[75] Inventor: Toshiki Kagami, Tokyo, Japan

[73] Assignee: Sony Corporation, Tokyo, Japan

[21] Appl. No.: 09/013,893

[22] Filed: Jan. 27, 1998

[30] Foreign Application Priority Data

Jan. 29, 1997 [JP] Japan ..... 9-015629

[51] Int. Cl.[7] ..... B41J 2/195

[52] U.S. Cl. ..... 347/7; 347/85; 347/84; 347/81; 347/87; 347/44; 347/95

[58] Field of Search ..... 347/5, 6, 7, 47, 347/84, 85, 86, 87, 95, 100

[56] References Cited

U.S. PATENT DOCUMENTS

| | | | |
|---|---|---|---|
| 4,513,297 | 4/1985 | Okamura | 347/85 |
| 4,825,228 | 4/1989 | Glöeckler et al. | 347/7 |
| 4,827,278 | 5/1989 | Lecheheb | 347/7 |
| 4,862,192 | 8/1989 | Slomianny | 347/7 |
| 5,367,328 | 11/1994 | Erickson | 347/7 |
| 5,371,529 | 12/1994 | Eguchi et al. | 347/7 |
| 5,532,720 | 7/1996 | Krueger et al. | 347/7 |
| 5,757,390 | 5/1998 | Gragg et al. | 347/7 |
| 5,988,782 | 11/1999 | Miura et al. | 347/7 |

FOREIGN PATENT DOCUMENTS

| | | | |
|---|---|---|---|
| 403234661A | 10/1991 | Japan | 347/7 |
| 404366646A | 12/1992 | Japan | 347/7 |

*Primary Examiner*—Eugene Eickholt
*Attorney, Agent, or Firm*—Hill & Simpson

[57] ABSTRACT

A printer device for emitting a medium or mixing and emitting a medium for quantitation and a medium for emission, in which a correct recording image can be formed with a suppressed running cost. At least one tank 51 is provided which has at least one first liquid chamber 52 in which is disposed a liquid holder 53. A print head is provided which has a nozzle in association with this first liquid chamber 52. Preferably, at least one second tank is provided which has a second liquid chamber in association with the first liquid chamber 52 of the first tank 51 for direct communication between the two chambers. The printer device can be configured for emitting only the emission medium of mixing the quantitation medium and the emission medium and emitting the resulting mixed liquid.

25 Claims, 20 Drawing Sheets

PRINTER DEVICE

BACKGROUND OF THE INVENTION

1. Field of the invention

This invention relates to a printer device for emitting a medium for emission or mixing and emitting a medium for quantitation and a medium for emission. More particularly, it relates to a printer device in which a tank charged with the medium for emission and the medium for quantitation is divided into two for suppressing the running cost for enabling formation of a correct recording image.

2. Description of the Related Art

Recently, computerized document preparation, termed desk publishing, has become popular particularly in an office, such that an increasing demand is raised for outputting not only letters or figures but also colored natural images, such as photos, along with the letters or figures. In keeping up therewith, it is required to have a natural high-quality image printed such that regeneration of a half tone is becoming crucial.

On the other hand, a so-called on-demand type printer device, which emits ink droplets only when required for effecting printing on a recording material, such as films, responsive to printing signals, is being used in increasing numbers because it can be reduced in size and cost.

Among a variety of methods for emitting the ink droplets, a method employing a piezoelectric device and a device employing a heat emitting device are most customary. The former method applies a pressure to the ink by deformation of the piezoelectric device for emitting the ink, while the latter method heats and boils the ink by the heating device for generating bubbles for pressurizing and emitting the ink.

There are a variety of methods proposed for realizing the above-mentioned the half-tone with the above-mentioned on-demand type printer device emitting the ink liquid droplets. The first of these varies the voltage or pulse width of voltage pulses applied to the piezoelectric device or the heating device for controlling the size of the emitted liquid drop to vary the diameter of the printing dots for representing the gradation.

However, with this method, the ink becomes unable to be emitted if the voltage or the pulse width applied to the piezoelectric device or the heating device is lowered excessively. Thus, there is a limitation to the minimum liquid drop size such that the number of stages of the gradation that can be represented is only small. In particular, the low concentration cannot be represented with ease such that the natural image cannot be printed out satisfactorily.

The second method is to construct a pixel of an image by a matrix of, for example, 4×4 dots, without varying the dot diameter, and to represent the gradation using the so-called dither method on the matrix basis. In this case, 17 stages of the gradation can be represented.

However, if this second method is used for printing with the same dot density as that in the first method, the resolution is one-fourth of that of the first method such that the image is coarse. Thus, this second method is insufficient for printing out the natural image.

The present inventors have proposed a printer device in which the ink and a dilution liquid are mixed together in emitting the ink for varying the concentration of the emitted ink liquid droplets for controlling the concentration of printed dots for printing out a natural image without deteriorating the resolution.

As a printer head for this type of the printer device, there is such a printer head having an emission medium nozzle for introducing the emission medium and a quantitation medium nozzle for introducing the quantitation medium, opening in adjacency to the emission medium nozzle, in which a pre-set amount of the quantitation medium is oozed out from the quantitation medium nozzle towards the emission medium nozzle for mixing with the emission medium in the vicinity of the opening end of the emission medium nozzle, the emission medium is extruded from the emission medium nozzle along with the emission medium mixed with the quantitation medium for mixing and emitting the quantitation medium and the emission medium in an in-plane direction of the quantitation medium nozzle and the emission medium nozzle. In such printer device, the quantitation medium, which is the ink or the dilution liquid, is varied for varying the mixing ratio of the ink and the dilution liquid for varying the dot concentration for printing out the natural image. Meanwhile, one of the quantitation medium nozzle and the emission medium nozzle may be the ink, with the outer being the dilution liquid.

In such printer device, the print head is moved on a recording surface of the recording material for forming dots of a pre-set concentration at a pre-set position for forming the recording image.

In a printer device having a printer head mixing and emitting the quantitation medium and the emission medium, or a printer device having a printer head emitting only the ink as an emission medium, it is necessary to provide a tank having liquid chambers for supplying the quantitation medium and the emission medium to a quantitation medium nozzle and a emission medium nozzle of the printer head.

In these printer devices, the tank is adapted for being moved along with the printer head on a recording surface of the recording material. Alternatively, a tank is provided fixedly and interconnected with the printer head by connection means, such as a tube, so that only the printer head is moved on the recording surface of the recording material.

In the former method, if the emission medium or the quantitation medium is charged in excessive quantities in a liquid chamber of the tank, the printer head and the tank become heavy such that a large load is imposed on driving means, such as a motor, adapted for moving the printer head and the tank on the recording surface, such that the motor is required to develop a large driving force. Moreover, since the driving power is increased, the running cost is undesirably increased.

Since the printer head and the tank are heavy in weight, these can hardly be brought into registration with each other when moved on the recording surface. That is, registration accuracy is not high such that a correct recording image can hardly be produced.

Moreover, if the quantitation medium and the emission medium are stored in excessive amounts in the liquid chambers in the tank, the quantitation medium and the emission medium charged in the quantitation medium nozzle or the emission medium nozzle connected to the liquid chamber undergo fluctuations thus causing fluctuations in the amounts of the quantitation medium and the emission medium to render it difficult to form the dots of a pre-set size or a dot of a pre-set concentration or to form a correct recording image. If such fluctuations in the meniscus are produced, the probability is high that air bubbles shall be mixed into the quantitation medium or the emission medium in the nozzle from the distal ends of the nozzles. This again causes fluctuations in the amounts of the quantitation medium or the emission medium to render it difficult to form dots of a pre-set size of pre-set concentration or to produce a correct recording image.

If the amount of the quantitation medium or the emission medium in the liquid chambers of the tank is small, the quantitation medium or the emission medium is oscillated in the liquid chambers due to inertia thus generating air bubbles to obstruct supply of the quantitation medium or the emission medium to detract from the emission stability of the nozzles to render it difficult to form a correct recording image.

If the capacity of the liquid chamber of the tank is small, the tank needs to be exchanged frequently by a laborious operation. Also, if the quantitation medium or the emission medium is supplemented by tank exchange, the probability is high that air bubbles shall be produced in a connection portion between the tank and the printer head at the tank attachment and removal. These air bubbles tend to be intruded into the liquid chambers to obstruct supply of the quantitation medium or the emission medium to the quantitation medium nozzle or to the emission medium nozzle to detract from emission stability of these nozzles to render it difficult to generate correct recorded images. Although it may be contemplated to overcome this inconvenience by sucking the distal ends of the quantitation medium nozzle or the emission medium nozzle for emitting the air bubbles to outside, the quantitation medium or the emission medium sucked along with the air bubbles are wasted to undesirably increase the running cost.

It has also been proposed to provide for a fixed tank to interconnect the printer head and the tank by a tube or to divide the tank into a first tank of a smaller capacity moved along with the printer head and a main second tank of a larger capacity and to interconnect the first and second tanks by a tube for eliminating the inconvenience caused by the inertia at the time of movement of the printer head.

However, with the present method, the tube is passed through by air such that air bubbles are produced in the tube and intruded into the liquid chambers to produce the above inconvenience. Moreover, since the tube is whirled in keeping with movement of the printer head, fluctuations are produced in the quantitation medium or the emission medium in the tube due to inertia thus causing fluctuations in the quantitation medium or the emission medium charged in the quantitation medium nozzle or in the emission medium nozzle, or fluctuations in the meniscus in the distal ends of the nozzles, thus causing fluctuations in the volume of the quantitation medium or the emission medium to render it difficult to from dots of a pre-set size of pre-set concentration and hence to produce a correct recording image. In particular, if the tube is of an increased length, the tube tends to fall into disorder such that the above-mentioned fluctuations in the meniscus tend to be produced to increase the possibility of the air bubbles mixing into the quantitation medium or the emission medium. This again causes fluctuations in the amount of the quantitation medium or the emission medium to render it difficult to form dots of a pre-set size or the pre-set concentration and hence to form a correct recording image.

SUMMARY OF THE INVENTION

It is therefore an object of the present invention to provide a printer device in which the running cost can be suppressed to render it possible to form a correct recording image.

In one aspect, the present invention provides a printer device including a printer head having at least a first tank including at least one first liquid chamber having a liquid holder arranged therein and a nozzle communicating with the first liquid chamber and a second tank having at least a second liquid chamber in association with the first liquid chamber. The printer head is moved on a recording surface of the recording material for doing recording. The liquid holder contains and holds the quantization medium or the emission medium therein and may be formed of a material having properties like the quantization medium or the emission medium, such as polyether, polyvinyl alcohol, melamine or polyolefin.

In another aspect, the present invention provides a printer device including a printer head having a first nozzle into which is introduced a quantitation medium and a second nozzle into which is introduced an emission medium, the printer head being moved on a recording surface of a recording material, a first tank having a first liquid chamber communicating with the first nozzle and a first liquid chamber communicating with the second nozzle, the first tank being moved along with the printer head on the recording surface of the recording material, and a second tank having a second liquid chamber provided on a non-recording area of the recording material in association with the first liquid chamber communicating with the second nozzle and a second liquid chamber in association with the first liquid chamber communicating with the second nozzle. The second tank causes the first tank to be moved when the quantity of the quantitation medium or the emission medium in the first liquid chamber falls below a pre-set value for charging the quantitation medium or the emission medium from the second liquid chamber to the first liquid chamber.

Thus, if the first tank connected to the printer head is moved along with the printer head, the first tank can be held in stability without dependency on the amounts of the quantitation medium or the emission medium for suppressing fluctuations in the quantitation medium or the emission medium charged into the quantitation medium nozzle or in the emission medium nozzle thus suppressing fluctuations in the meniscus at the distal ends of these nozzles or in the quantities of the quantitation medium or the emission medium to enable dots to be formed to a pre-set size or a pre-set concentration to assure generation of a correct recording image.

Also, if, in the printer device of the present invention, at least one second tank is provided which has the second liquid chamber in association with the first liquid chamber of the first tank, and the first and second tanks are of a smaller capacity and a larger capacity, respectively, the first tank can be moved along with the printer head with a smaller power consumption than heretofore because the first tank and the printer head are lighter in weight. Therefore, driving means with a smaller driving power suffices to suppress the running cost.

Since the first tank and the printer head are lighter in weight, registration between these two components can be realized easily when these components are moved on the recording surface thus assuring registration accuracy and generation of a correct recording image.

Moreover, since the quantitation medium or the emission medium can be replenished in the second tank without the necessity of dismounting the first tank connected to the printer head, there are produced no air bubbles in the first liquid chamber of the first tank thus maintaining nozzle emission stability for generating the correct recording image.

Also, if there is provided sensor means for detecting the quantity of the liquid held in the liquid holder in the liquid chamber, and if the liquid is adapted for being supplied from the second liquid chamber into the first liquid chamber when the liquid quantity in the first liquid chamber is found to be less than the pre-set quantity, there is no risk of the liquid leaking from the liquid holder in the first liquid chamber.

Moreover, if the first liquid chamber of the first tank is directly connected to the second liquid chamber of the second tank, associated therewith, that is if the printer head is formed as-one molding with the first tank, there is no necessity of interconnecting the printer head and the first tank by a tube, such that air bubbles are less likely to be produced, while fluctuations in the meniscus at the distal ends of the nozzles are less likely to be produced, thus assuring the generation of a more correct recording image.

DESCRIPTION OF PREFERRED EMBODIMENTS

Figure 1:
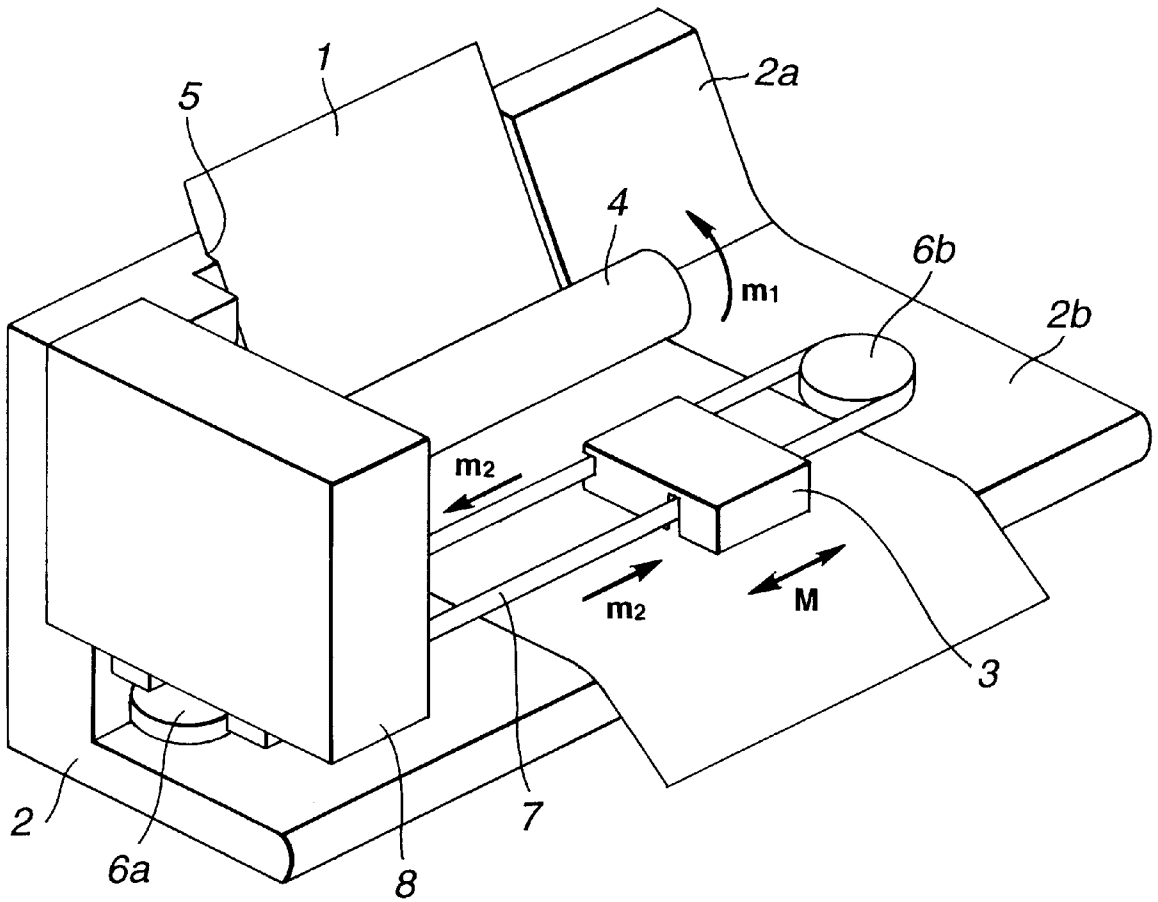
FIG. 1 is a perspective view showing essential portions of a printer device embodying the present invention.

Referring to the drawings, preferred embodiments of the present invention will be explained in detail. The following description is directed to a printer device in which the ink and the dilution liquid are used as the quantitation medium and as the emission medium, respectively, and in which the ink and the dilution liquid are mixed and emitted together.

FIG. 1 shows the structure of a printer device embodying the present invention. Specifically, the printer device is mainly constituted by a casing 2 supporting a printing paper sheet 1 and a printer head unit 3 for printing on the printing paper sheet 1.

The casing 2 is subsequently L-shaped and the printing paper sheet 1 is adapted to be fed out along the inner lateral surface of the bent portion. Specifically, a paper sheet feed groove 5 for supplying the printing paper sheet 1 is formed on an inner lateral surface 2*a* of the bent portion which is subsequently perpendicular to the bottom of the casing 1. The printing paper sheet 1 is fed out via this paper sheet feed groove 5 onto the inner lateral surface 2*b* of the bent portion extending parallel to the bottom surface of the casing 1.

On the bent portion of the casing 2 is mounted a paper sheet feed roll 4 for extending in a direction parallel to the longitudinal direction of the bent portion so that the printing paper sheet 1 is pressed and held against the vicinity of the bent portion of the casing 1. This paper sheet feed roll 4 is rotatable as indicated by arrow $m_1$ in FIG. 1. By rotation of the paper sheet feed roll 4, the printing paper sheet 1 is fed from the inner lateral surface 2*a* onto the inner lateral surface 2*b* as it is thrust by the paper sheet feed roll 4 against the inner lateral surfaces 2*a*, 2*b* of the casing 1.

On the inner lateral surface 2*b* of the casing 1 are mounted a pair of pulleys 6*a*, 6*b* around which a belt 7 is supported in an elliptical configuration. By rotation of the pulleys 6*a*, 6*b*, the belt 7 is rotated in the longitudinal direction in the plane of the inner lateral surface 2*b* as indicated by arrow $m_2$ in the drawing. The printer head unit 3 is secured to a pre-set position of the belt 7, such that, by rotation of the belt 7, the printer head unit 3 is moved in the longitudinal direction in the plane of the inner lateral surface 2*b* as indicated by arrow M in the drawing. The rotation of the pulleys 6*a*, 6*b* and the movement of the printer head unit 3 are controlled by the printer head driver, printer head feed control and pulley rotation control based on the image printing data and driving signals.

In the above configuration, if the printer head unit 3 is moved to effect letter printing by one row, the paper sheet feed roll 4 is rotated by one row to effect letter printing for the next row. The printer head unit 3 is moved for letter printing in one direction or in reciprocating directions.

In this printer device, a second tank 8 for holding the ink as the quantitation medium and the dilution liquid as the emission medium therein is secured to the inner lateral surface 2*a* of the casing 2.

Figure 2:
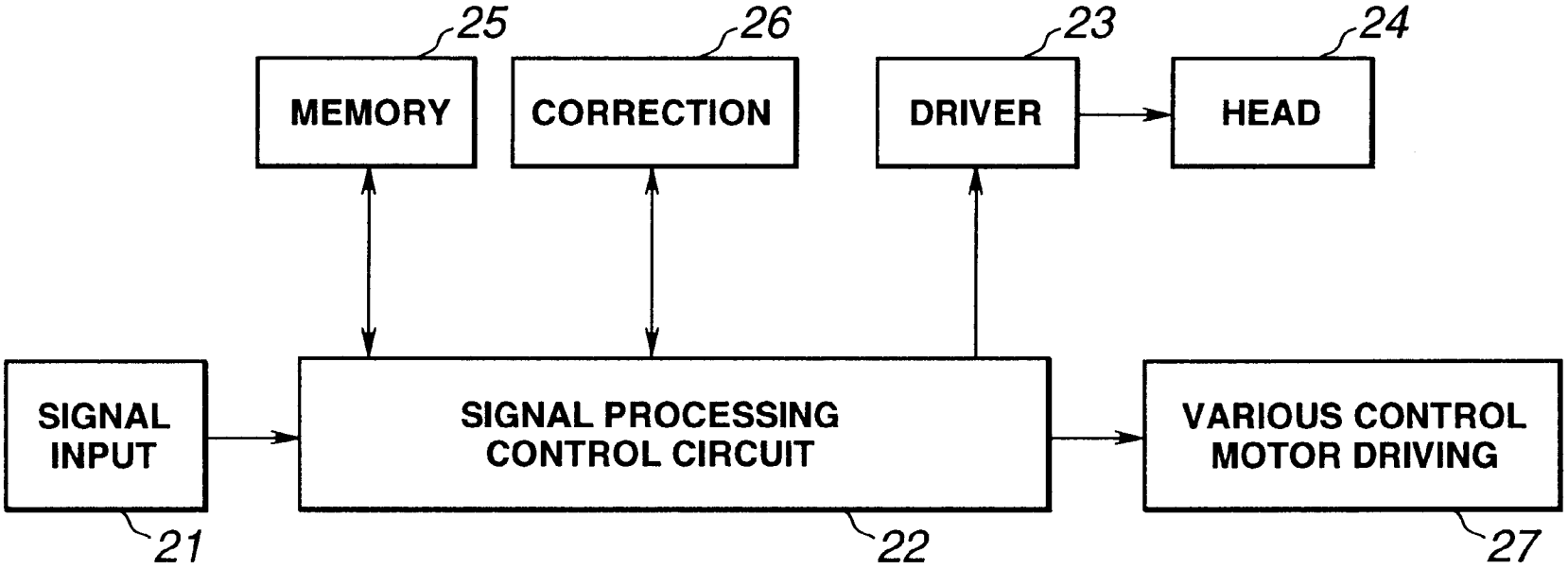
FIG. 2 is a block diagram showing a letter printing and controlling system of the printer device embodying the present invention.

FIG. 2 shows a block diagram of the letter printing and controlling system in this printer device. An input signal 21, such as letter printing data, is entered to a signal processing control circuit 22 where it is sorted in the letter printing sequence so as to be sent via a driver 23 to a head 24 (printer head). The letter printing sequence differs with the construction of the head 24 and the letter printing unit and is also influenced by the inputting sequence of the letter printing data. If necessary, the signal is transiently stored in a memory 25, such as a line buffer memory or a frame memory, from which it is taken out later. The gradation signal or the emission signal is entered to the head 24.

If the printer head is a multiple printer head 24 having an extremely large number of nozzles, the head 24 carries an IC for decreasing the number of interconnections to the head 24. A correction unit 26 is connected to the signal processing control circuit 22 for doing γ-correction, color correction, and correction of fluctuations of the printer heads. Usually, pre-set correction data are stored in a map configuration in the correction unit 26 so as to be taken out depending on external conditions, such as nozzle numbers, temperature or input signals.

Usually, the signal processing control circuit 22 is of a CPU or DSP configuration for processing by software. The processed signals are sent to a control motor driver 27. The control motor driver 27 performs control such as driving or synchronization of motors adapted for running the paper sheet feed roll or pulleys, cleaning of the printer heads or delivery and discharge of printing paper sheets. Of course, the operating signals or external control signals, other than the letter printing data, are contained in the signals.

Figure 3:
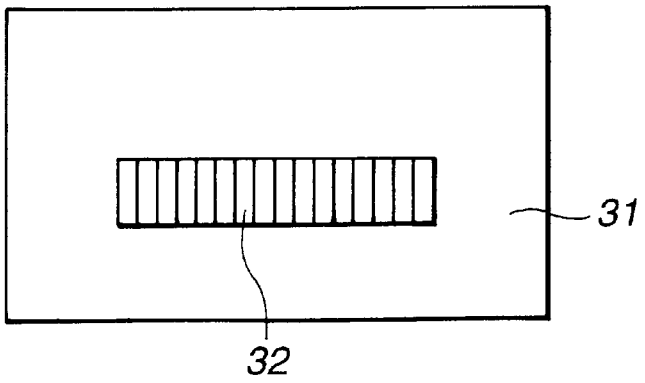
FIG. 3 is a plan view showing a printer head in the printer device embodying the present invention.
Figure 4:
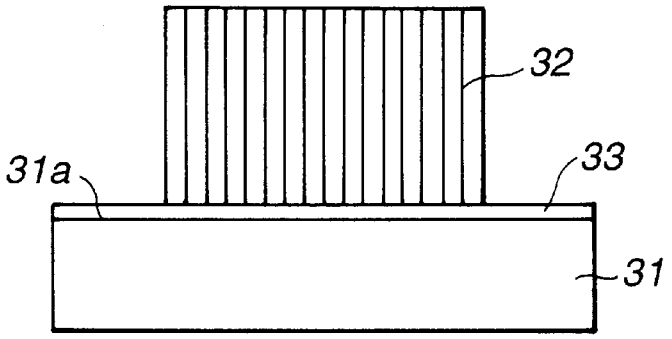
FIG. 4 is a front view of a printer head in the printer device embodying the present invention.
Figure 5:
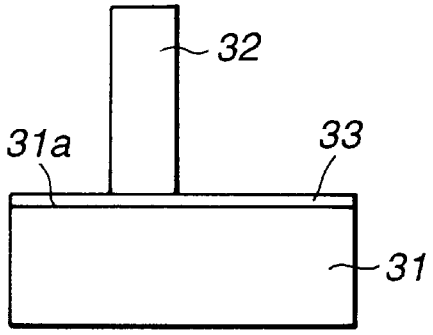
FIG. 5 is a side view of a printer head in the printer device embodying the present invention.

Referring to FIGS. 3 to 5, the printer head unit 3 mainly includes a print header base 31, a piezoelectric device 32 and a vibration plate 33.

The print header base 31 includes two types of the liquid supply ducts for reinforcing the printer head. If the quantitation medium and the emission medium are aqueous or oily, the print header base 31 is preferably formed of a material exhibiting water-proofness or oil-proofness, such as stainless steel, so as not be eroded by these liquids.

Figure 6:
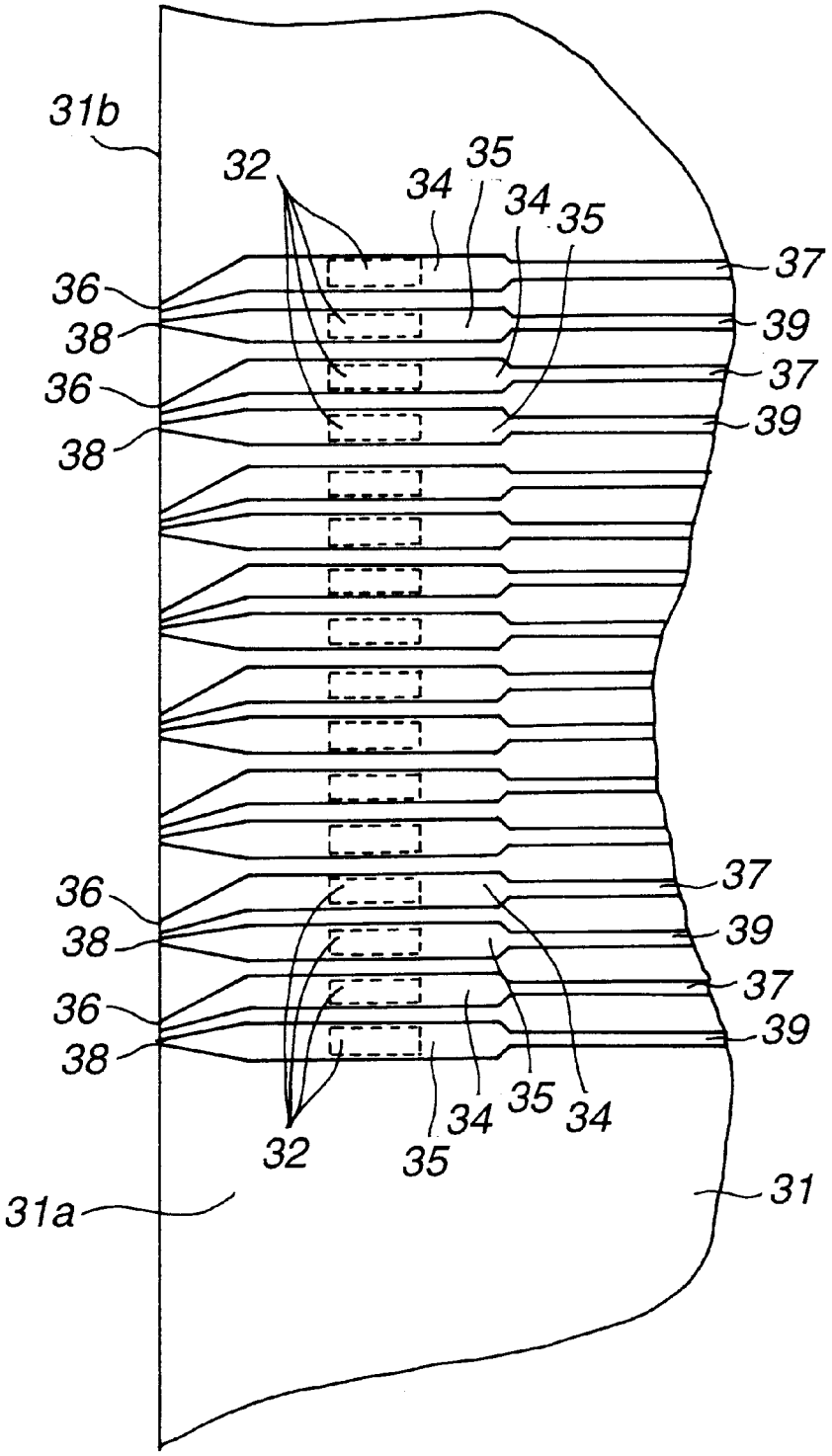
FIG. 6 is an enlarged plan view showing essential portions of a pressurizing chamber portion in the printer device embodying the present invention.

Referring to FIG. 6, on a major surface 31*a* of the print header base 31 are formed a quantitation medium pressurizing chamber 34 and an emission medium pressurizing chamber 35, into which are introduced the quantitation medium and an emission medium, respectively, independently of each other, as shown in FIG. 6.

The quantitation medium pressurizing chamber 34 is sized sufficiently to hold the liquid for quantitating e.g., the ink. The portion of the quantitation medium pressurizing chamber 34 provided with the piezoelectric device 32 is subsequently rectangular in the plan configuration, while the distal end thereof carrying the nozzle, that is the other lateral surface 31*b*, is narrow in width. On an opposite side lateral surface 31*b* of the print header base 31, which is the distal end of the quantitation medium pressurizing chamber 34 of narrow width, there is formed a quantitation medium nozzle 36 for allowing a quantitated quantitation medium to be oozed out.

To the quantitation medium pressurizing chamber 34 on the opposite side of the quantitation medium nozzle 36 is connected a flow duct 37 for introducing the quantitation medium into the quantitation medium pressurizing chamber 34. This flow duct 37 is formed as a straight groove for defining a flow duct of narrow width and plays the function of supplying the quantitation medium by the capillary action to the quantitation medium pressurizing chamber 34.

On the other hand, the portion of the emission medium pressurizing chamber 35 provided with the piezoelectric device 32 is subsequently rectangular in the plan configuration, as in the case of the quantitation medium pressurizing chamber 34, while the distal end thereof carrying the nozzle, that is the other lateral surface 31*b*, is narrow in width. On the opposite side lateral surface 31*b* of the print header base 31, which is the distal end of the emission medium pressurizing chamber 35 of narrow width, there is formed an emission medium nozzle 38. To the opposite side of the emission medium pressurizing chamber 35 with respect to the emission medium nozzle 38 is connected a flow duct 39 for allowing an emission medium, which is the dilution liquid, to be introduced into the emission medium pressurizing chamber 35.

The quantitation medium pressurizing chamber 34, emission medium pressurizing chamber 35, quantitation medium nozzle 36, emission medium nozzle 38 and the flow ducts 37, 39 are formed as recesses in cross-section, in the major surface 31*a* of the print header base 31, such as by machining, for example, end milling, or by etching.

Since the quantitation medium nozzle 36 and the emission medium nozzle 38 tend to become spherically-shaped due to surface tension of the ink or the dilution liquid, the outlet may be circular or rectangular in shape. If the opening shape of the quantitation medium nozzle 36 and the emission medium nozzle 38 are rectangular in shape, the groove width is 5 to 200 $\mu$m and preferably 20 to 80 $\mu$m. The groove depth is 5 to 100 $\mu$m and preferably 15 to 50 $\mu$m. If the nozzles are increased in width or depth, the emitted liquid drop is increased in size. Therefore, the nozzle width and depth are selected in meeting with the desired dot size. The quantitation medium nozzle 36 and the emission medium nozzle 38 need not be equal but different in areal measure.

Figures 7A, 7B, 7C:
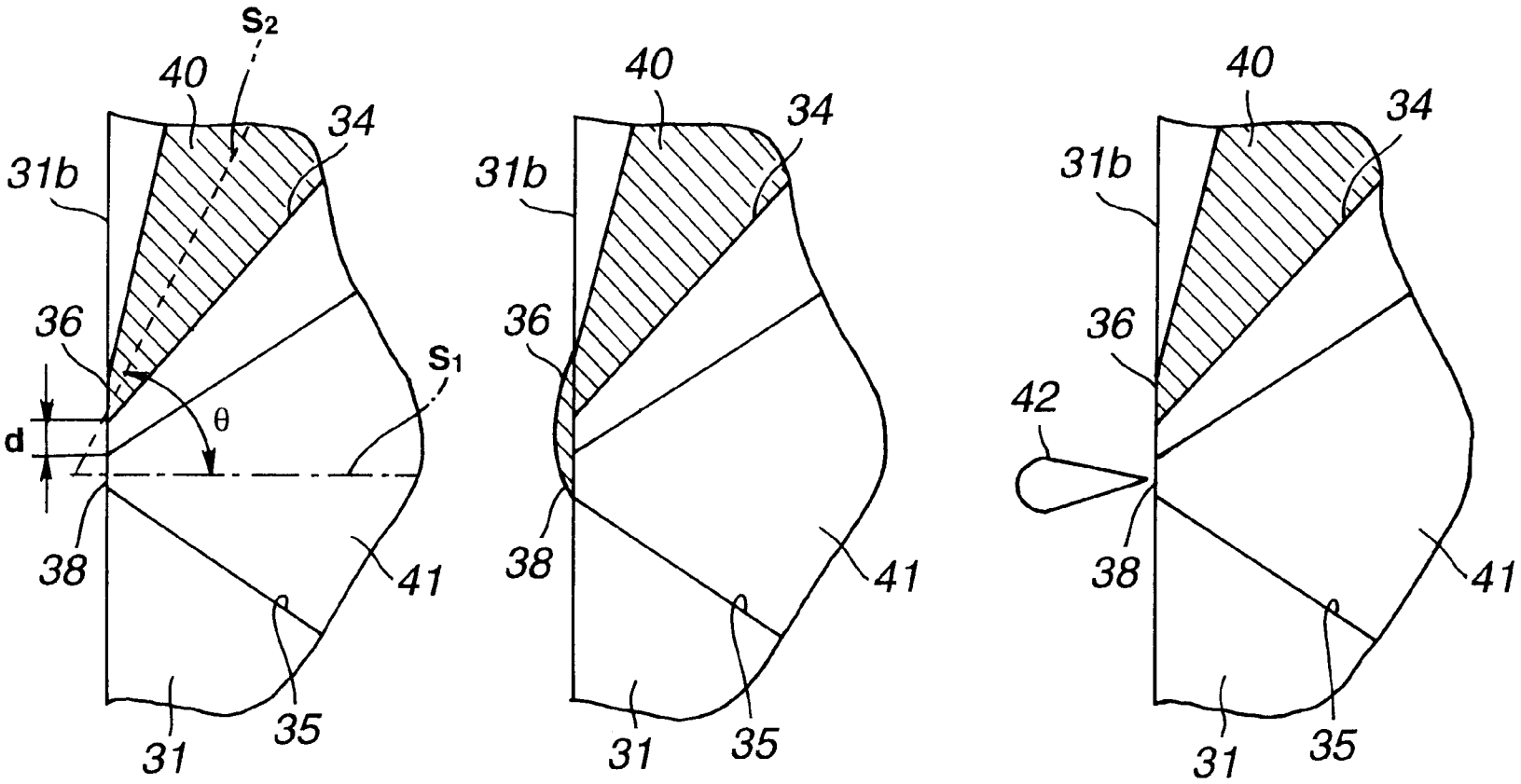
FIGS. 7*a*, 7*b* and 7*c* are enlarged schematic plan views for illustrating the emission operation in the printer device embodying the present invention.

On the other hand, a distance d between the quantitation medium nozzle 36 and the emission medium nozzle 38 as shown in FIG. 7*a* is preferably 5 to 200 $\mu$m for preventing the ink and the dilution liquid from being mixed spontaneously during emission stand-by time. For allowing the quantitation medium as the quantitation liquid to have easy access to the emission medium as the emission liquid, the distal end of the quantitation medium pressurizing chamber 34 is inclined at an inclination angle $\theta$ of 5° to 90° relative to the distal end of the emission medium pressurizing chamber 35. This inclination angle $\theta$ is an angle between line S1 interconnecting the center of the quantitation medium nozzle 36 and the center of the quantitation medium pressurizing chamber 34 and a line Switch element block 2 interconnecting the center of the quantitation medium nozzle 36 and the center of the emission medium pressurizing chamber 35.

The quantitation medium pressurizing chamber 34 and the emission medium pressurizing chamber 35, thus constituted, make up a sole printer head. A set of printer heads, each made up of the quantitation medium pressurizing chamber 34 and the emission medium pressurizing chamber 35, is arranged in the sole plane of the print header base 31 at a spacing between the neighboring printer heads. In the present embodiment, the quantitation medium pressurizing chamber 34 and the emission medium pressurizing chamber 35 are arrayed alternately beginning from the upper end of FIG. 6. However, the quantitation medium pressurizing chamber 34 may be arranged on the right side or on the left side of the emission medium pressurizing chamber 35, if desired.

The quantitation medium pressurizing chamber 34 and the emission medium pressurizing chamber 35 may be arrayed at an optional pitch.

The vibration plate 33 is provided in tight contact with the major surface 31*a* of the print header base 31 via an adhesive film in-between. Although a liquid adhesive may be used for bonding the vibration plate 33 to the print header base 31, it is more preferred to use an adhesive tape, such as a dry film, because it is not that easy to bond the vibration plate 33 to the print header base 31 such as not to permit the adhesive to flow into the quantitation medium pressurizing chamber 34, emission medium pressurizing chamber 35, quantitation medium nozzle 36 or into the emission medium nozzle 38. It is noted that the adhesive is reduced in thickness for efficient transmission of displacement of the piezoelectric device 32.

On the other hand, the piezoelectric device 32 is used for quantitating or emitting the quantitation medium or the emission medium charged into the quantitation medium pressurizing chamber 34 or into the emission medium pressurizing chamber 35, and is provided via a vibration plate 33 in register with each of the quantitation medium pressurizing chamber 34 and the emission medium pressurizing chamber 35. Based on letter printing data quantitation pulses or emission pulses are applied t o the piezoelectric device 32. Specifically, the quantitation pulses are applied to the piezoelectric device 32, provided in association with the quantitation medium pressurizing chamber 34, whilst the emission pulses are applied to the piezoelectric device 32 provided in association with the emission medium pressurizing chamber 35.

These piezoelectric devices 32 are formed as rectangular electrodes, provided on opposing upper and lower surfaces of sintered ceramics, and subsequently cut, such as by dicing, so as to be in one-to-one correspondence with the quantitation medium pressurizing chamber 34 and the emission medium pressurizing chamber 35. These piezoelectric devices 32 are preferably of a narrow width for assuring facilitated displacement of the vibration plate 33. For example, if the cutting edge of the blade used for dicing is 200 $\mu$m and is used for cutting the piezoelectric devices 32 at a pitch of 300 $\mu$m, the piezoelectric device 32 thrusting the vibration plate 33 is of a width of 100 $\mu$m.

In the above-described printer head, if an ink 40 and a dilution liquid, such as water, are introduced into the quantitation medium pressurizing chamber 34 and into the emission medium pressurizing chamber 35, respectively, the resulting mixed liquid is emitted as follows: First, subsequently trapezoidal-shaped quantitation pulses, as shown in FIG. 8*b*, are applied to the piezoelectric device 32 provided in register with the quantitation medium pressurizing chamber 34. This allows the ink 40, quantitated by the quantitation medium nozzle 36, to be oozed out as shown in FIG. 7*b*, beginning from the initial state of FIG. 7*a* in which the two liquids have formed a meniscus by surface tension without being extruded from the respective nozzles. Since the quantitation medium nozzle 36 is inclined towards the emission medium nozzle 38, the ink 40 approaches to the emission medium nozzle 38 on the emission side.

Figure 8A:
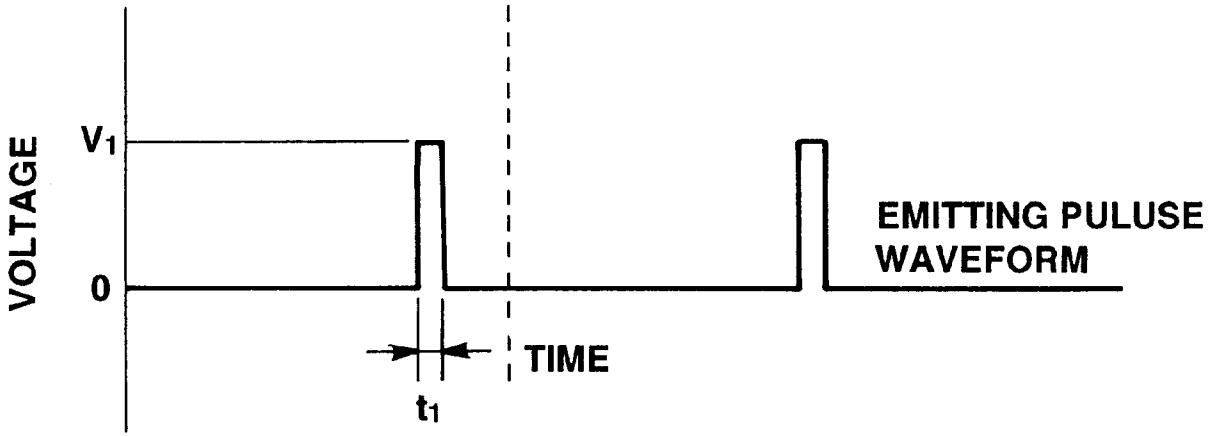
FIGS. 8*a* and 8*b* show an emission pulse waveform and a quantitation pulse waveform applied to a piezoelectric device provided on the quantitation side and a piezoelectric device provided on the emission side, respectively.
Figure 8B:
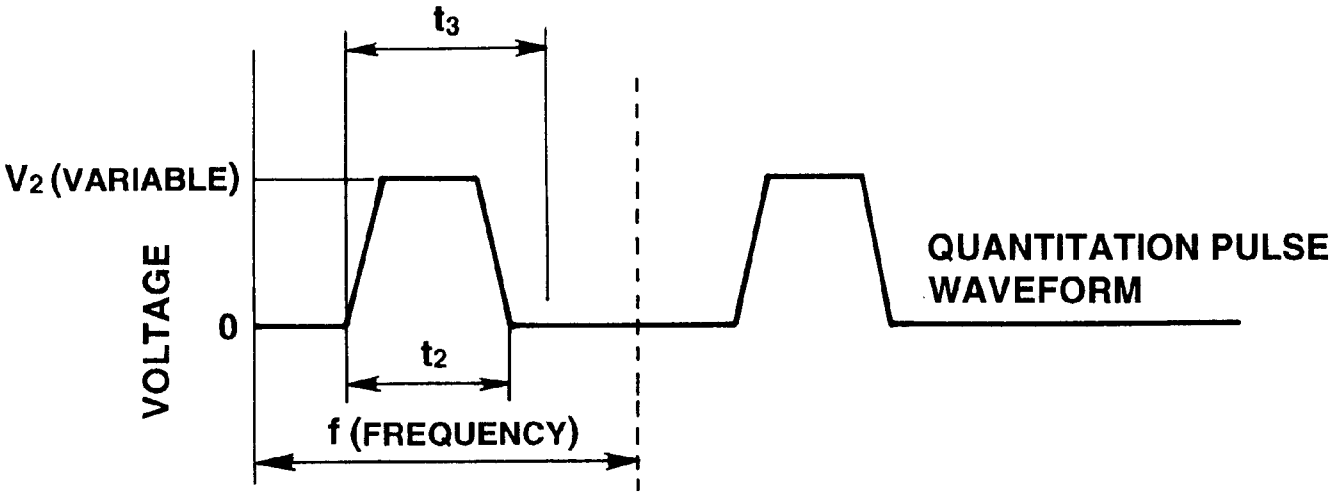

To the piezoelectric device 32, provided in association with the emission medium pressurizing chamber 35, rectangular-shaped emission pulses, as shown in FIG. 8*a*, are applied. This mixes the quantitated ink 40 with the dilution liquid 41 on the surface of the print header base 31 to emit a dot by a mixed liquid 42 of the ink 40 and the dilution liquid 41 from the emission medium nozzle 38 towards the recording medium.

The amount of the quantitation medium, which is the ink, is varied for varying the mixing ratio of the ink and the dilution liquid, for thereby varying the concentration of each dot for moving the print head unit on the recording surface of the recording material. This forms the dot of the pre-set concentration at the pre-set position for forming a recording image.

The ink and the dilution liquids of the following compositions may be used:

[Ink Composition]

| | |
|---|---|
| dye (C.I. Direct Yellow 87) | 3 parts by weight |
| isopropyl alcohol | 5 parts by weight |
| glycerin | 2 parts by weight |
| diethylene glycol | 6 parts by weight |
| pure water | 84 parts by weight |

-continued

| [Composition of Dilution Liquid] | |
|---|---|
| pure water | 60 parts by weight |
| diethylene glycol | 20 parts by weight |
| isopropyl alcohol | 20 parts by weight |

In the present embodiment of the printer device, the printer head unit has, in addition to the above-described printer head, a first tank for supplying the quantitation medium and the emission medium to the quantitation medium pressurizing chamber, quantitation medium nozzle, emission medium pressurizing chamber and to the emission medium nozzle.

Figure 9:
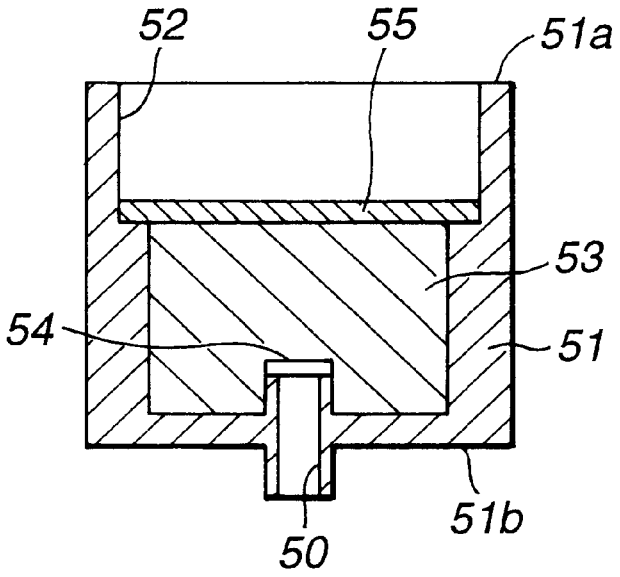
FIG. 9 is a schematic cross-sectional view showing essential portions of an illustrative first tank of the printer device embodying the present invention.

Referring to FIG. 9, a first tank 51 has a liquid chamber 52 which is formed as a recess opened in a major surface 51*a* as an upper surface. The first tank also has a supply port 50 which is formed in a major surface 51*b* as its bottom surface and which is connected to the quantitation medium pressurizing chamber or the emission medium pressurizing chamber.

In the liquid chamber 52 is formed a liquid holder 53 containing and holding the quantitation medium or the emission medium therein. The liquid holder 53 may be formed of a material exhibiting resistance against the quantitation medium and against the emission medium, such as polyether, polyvinyl alcohol, melamine or polyolefin. The liquid holder 53 is of specifications capable of holding a required quantity of the quantitation medium or the emission medium. These specifications are determined by the viscosity, surface tension or composition of the quantitation medium or the emission medium depending on the period of quantitation or emission.

On the side of the liquid holder 53 of the supply port 50 is arranged a filter 54 for preventing intrusion of dust and dirt when supplying the quantitation medium or the emission medium contained in the liquid holder 53 via the supply port 50 to a supply duct. Although an ordinary filter may be used as the filter 54, such a filter that is not liable to entanglements should be used because the filter, if entangled, proves to be a source of dust and dirt.

On the opening side of the liquid holder 53 is arranged a plate 55 for reducing the contact surface of the liquid holder 53 with atmospheric air. This plate 55 is preferably formed of a material having resistance against the quantitation medium and the emission medium, such as stainless steel.

Figure 10:
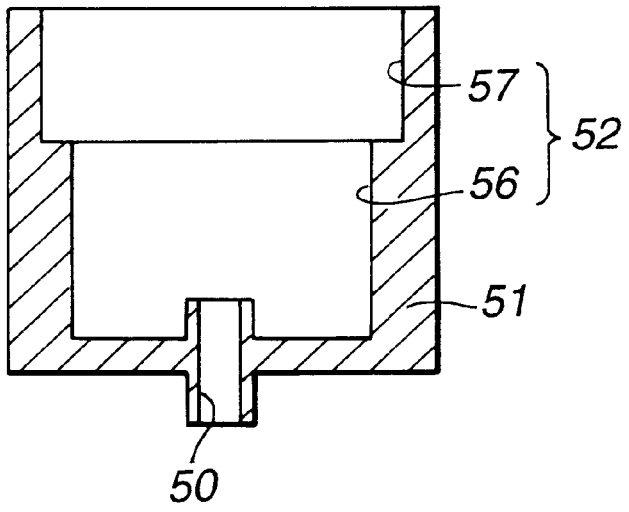
FIG. 10 is a cross-sectional view showing the illustrative first tank of the printer device embodying the present invention.
Figure 11:
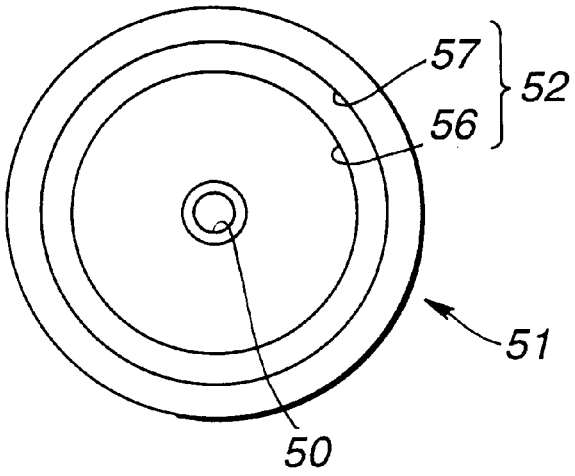
FIG. 11 is a plan view showing the illustrative first tank of the printer device embodying the present invention.
Figure 12:
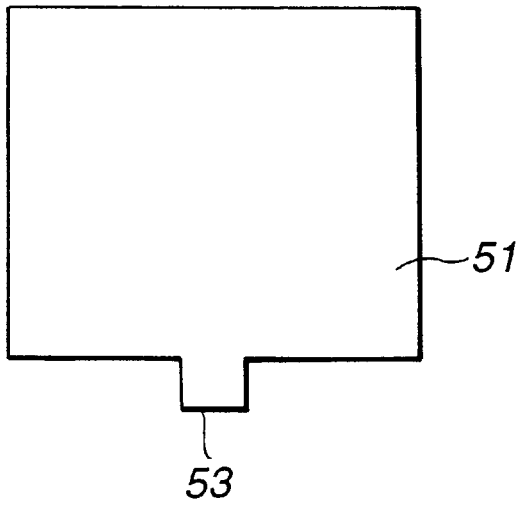
FIG. 12 is a side view showing the illustrative first tank of the printer device embodying the present invention.

The first tank 51 has the liquid chamber 52 which, as shown in FIGS. 10 to 12, is formed by a relatively small-sized cylindrically-shaped liquid holder container 56 and a relatively large-sized cylindrically-shaped liquid receiver 57 formed thereon. The depth of the liquid holder container 56 is set so as to be equal to the height of the liquid holder. This first tank 51 is formed of a material having resistance against the quantitation medium and the emission medium, such as polypropylene or polyethylene terephthalate. Since the plate 55 need not necessarily be contacted with the liquid holder 53, the plate 55 may be formed as a disc of a subsequently equal radius as the liquid receiver 57, so that there is no risk of the plate 55 being caught by the step between the liquid receiver 57 and the liquid holder container 56 to cause the plate 55 to excessively thrust the liquid holder 53. There is no problem if the plate 55 is simply set on the liquid holder 53 or if the plate is bonded or fitted thereto.

Figure 13:
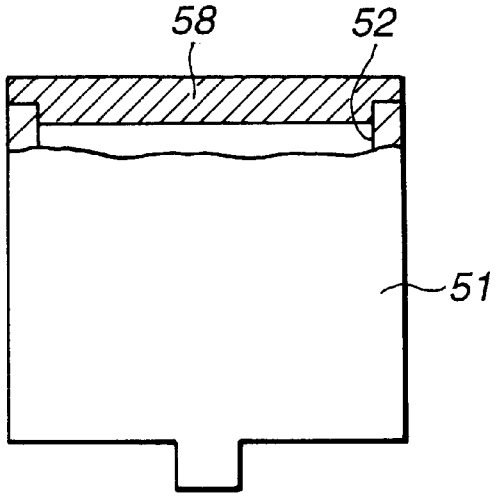
FIG. 13 is a side view showing the first tank fitted with a lid, with a portion thereof being broken away.

The first tank 51 may also be provided with a lid 58 adapted for closing the opening of a recess 52, as shown in FIG. 13.

The present embodiment of the printer device also has a second tank which is adapted for supplying the quantitation medium and the emission medium to the first tank 51 and which is secured to the casing without being moved with the printer head unit. This second tank has one or more second liquid chamber(s) which is of a capacity capable of repeatedly supplying the quantitation medium or the emission medium to the first liquid chamber of the first tank. Specifically, the liquid chamber 52 of the first tank 51 is of a smaller capacity, whilst the second liquid chamber of the second tank is of a larger capacity.

This second chamber also is preferably formed of a material having resistance against the quantitation medium and against the emission medium, such as polypropylene or polyethylene terephthalate.

The second liquid chamber of the second tank is directly connected to the first liquid chamber of the first tank. Specifically, if the second tank has a second liquid chamber and the number of the second tank(s) corresponds to the number of the first tank(s), the second liquid chamber of the second tank is located in the liquid receiver of the first liquid chamber of the first tank when the printer head unit is in register with the second tank. Thus, the quantitation medium and the emission medium can be directly supplied without the necessity of providing a supply port in the bottom of the second liquid chamber of the second tank or of connecting the second liquid chamber of the second tank with the first liquid chamber of the first tank via another member such as a tube. This supplying method will be explained subsequently.

Figure 14:
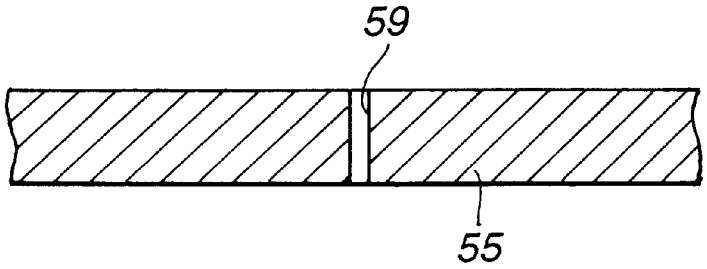
FIG. 14 is a cross-sectional view showing an embodiment of a plate of the printer device embodying the present invention.
Figure 15:
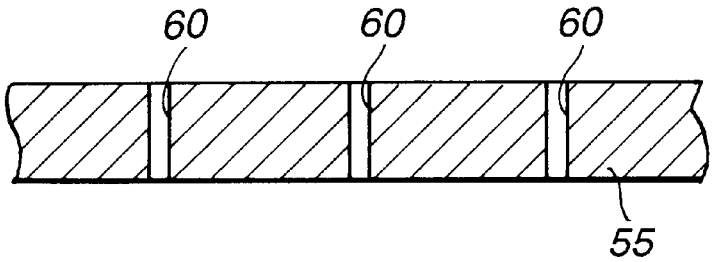
FIG. 15 is a cross-sectional view showing another embodiment of a plate of the printer device embodying the present invention.

Thus, the plate 55 arranged on the top of the liquid holder 53 as shown in FIG. 9 is formed with a through-hole 59 as shown enlarged in FIG. 14 or with plural through-holes 60 as shown enlarged in FIG. 15. The through-hole 59 is large enough in diameter to permit the quantitation medium or the emission medium supplied from the second liquid chamber of the second tank to be supplied from the liquid receiver of the first liquid chamber of the first tank to the liquid holder container, whilst the through-holes 60 are also large enough in area to permit passage therethrough of these liquids.

This tank is configured as a bottle the inside of which is charged with the quantitation medium and the emission medium. The second tank is plugged at the time of shipment and the plug is removed when the second tank is set upside-down on the first tank so that the supply port is formed on the bottom.

In this case, the second tank need to be provided with an openable valve. The inside of the first liquid chamber of the first tank needs to be provided with means for sensing the quantity of the liquid held by the liquid holder such that the valve of the second tank is opened when the quantity of the liquid holder becomes smaller than a prescribed amount to permit the quantitation medium or the emission medium to be supplied from the second liquid chamber of the second tank to the first liquid chamber of the first tank. This prescribed quantity may be set to 50% of the maximum holding quantity of the liquid holder, such that, if the liquid holding quantity becomes smaller than this prescribed value, the quantitation medium or the emission medium may be supplied to the first liquid chamber of the first tank so that the liquid holding quantity of the liquid holder will be not less than 50% of the maximum holding quantity. On the other hand, if the liquid holding quantity is larger than 50% of the prescribed value, it is sufficient if the quantitation medium or the emission medium is not supplied from the second liquid chamber of the second tank to the first liquid chamber of the first tank. If plural first liquid chambers are provided in the first tank, the quantitation medium or the emission medium is supplied from the second liquid chamber of the second tank to the first liquid chamber of the first tank at the time point when the liquid holding quantity of one of these liquid holders 53 becomes smaller than 50% of the maximum liquid holding quantity.

It is also possible to use a second tank having plural second liquid chambers, in which case a number of the second liquid chambers corresponding to the number of the first tanks is provided and the arrangement is so made that the liquid chambers of the second tanks will be positioned on the liquid receivers of the first liquid chambers of the first tank, while a supply port fitted with a valve is provided in the bottom of each liquid chamber of the second tank so that the quantitation medium and the emission medium will be directly supplied from the second liquid chamber of the second tank to the first liquid chamber of the first tank.

Figure 16:
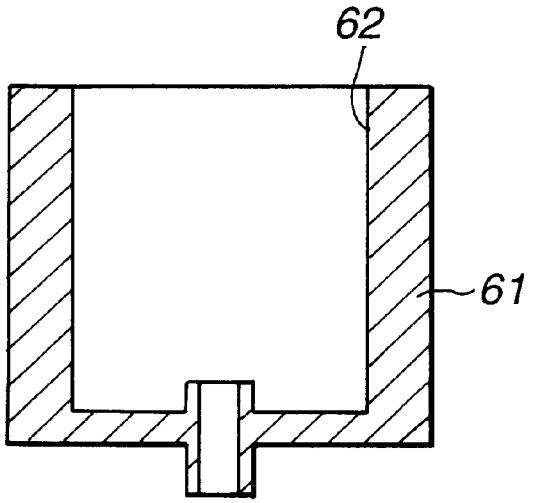
FIG. 16 is a cross-sectional view showing another embodiment of the first tank of the printer device embodying the present invention.
Figure 17:
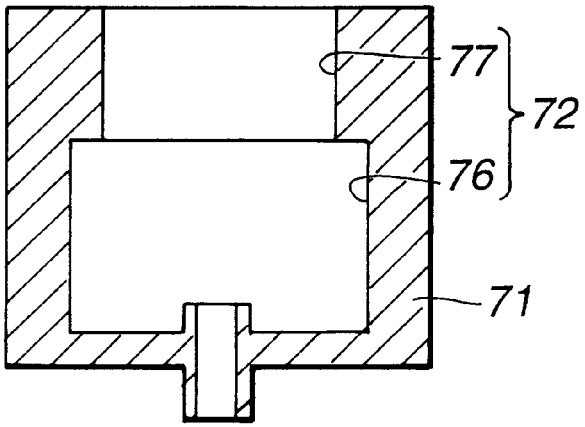
FIG. 17 is a cross-sectional view showing still another embodiment of the first tank of the printer device embodying the present invention.
Figure 18:
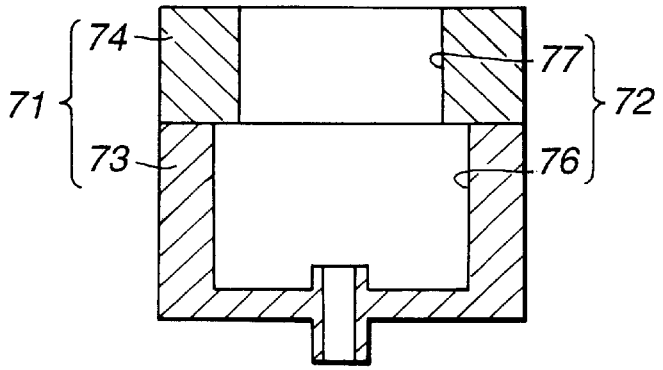
FIG. 18 is a cross-sectional view showing yet another embodiment of the first tank of the printer device embodying the present invention.

The foregoing description has been directed to an embodiment in which the first tank 51 is constructed so that the first liquid chamber 52 is made up of the cylindrically-shaped liquid holder container 56 of a smaller size and the cylindrically-shaped liquid receiver 57 of a larger size formed on its top. The first tank may, however, be constructed as a first tank 61 having a cylindrically-shaped first liquid chamber 62 whose diameter is not changed from the top to the bottom as shown in FIG. 16 or as a first tank 71 made up of a cylindrically-shaped liquid holder container 76 of a larger size and a cylindrically-shaped liquid receiver 77 of a larger size formed on its top, as shown in FIG. 17.

For inserting the liquid holder into the first liquid chamber 72 of the first tank 71, it is sufficient if the liquid holder is compressed so as to pass through the liquid receiver 77 and so as to be received in the liquid holder container 76. If difficulties are met in this case, the first tank 71 can be constructed by a first member 73 having the liquid holder container 76 and a second member 74 having the liquid receiver 77 and the first member 73 can be connected to the second member 74 after accommodating the liquid holder in the liquid holder container 76 of the first member 7.

Figure 19:
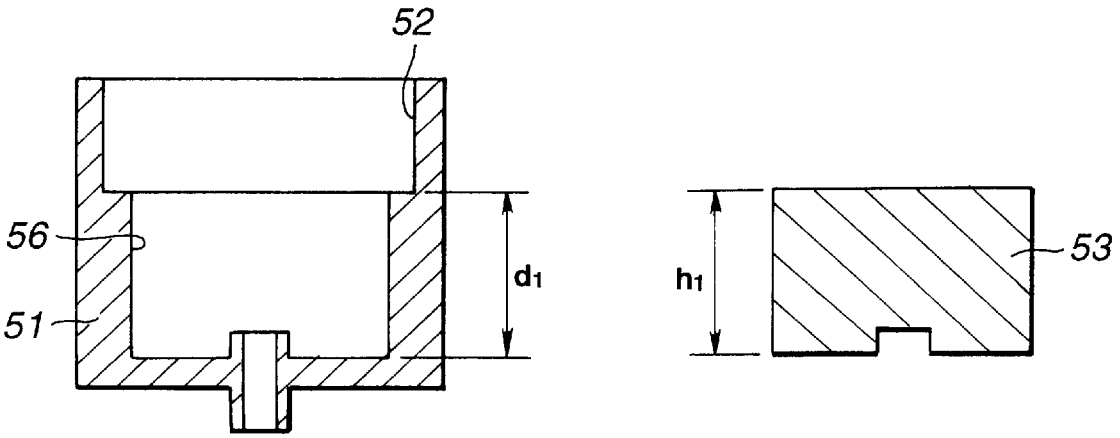
FIG. 19 is a cross-sectional view showing a typical relation between the depth of a liquid holder container and the height of the liquid holder of the printer device embodying the present invention.
Figure 20:
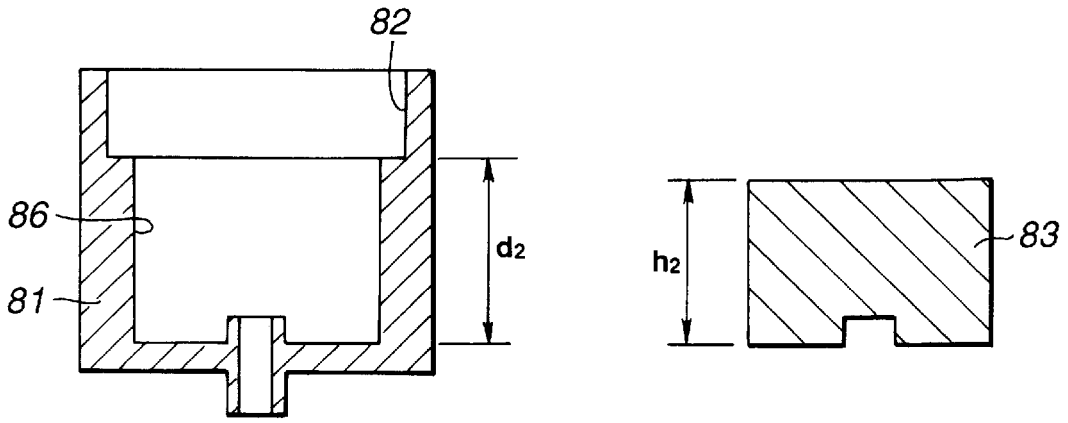
FIG. 20 is a cross-sectional view showing an example of the relation between the depth of a liquid holder container and the height of the liquid holder of the printer device embodying the present invention.
Figure 21:
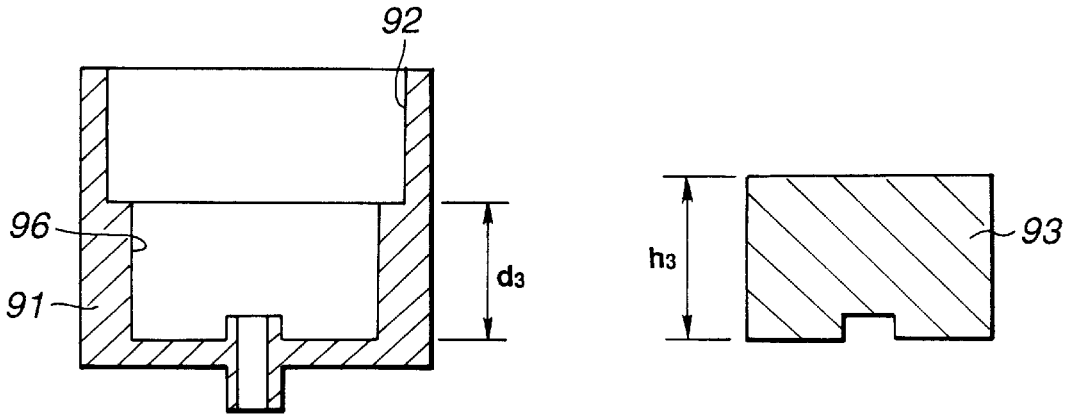
FIG. 21 is a cross-sectional view showing another example of the relation between the depth of a liquid holder container and the height of the liquid holder of the printer device embodying the present invention.

In the above-described embodiment, the depth d1 of the liquid holder container 56 of the first liquid chamber 52 is set so as to be equal to the height h1 of the liquid holder 53, as shown in FIG. 19. This relation may be modified so that the depth d2 of a liquid holder container 86 of a first liquid chamber 82 of a first tank 81 is larger than the height h2 of the liquid holder 83, as shown in FIG. 20, or so that the depth d3 of a liquid holder container 96 of a first liquid chamber 92 of a first tank 91 is smaller than the height h3 of a liquid holder 93, as shown in FIG. 21.

Figure 22A:
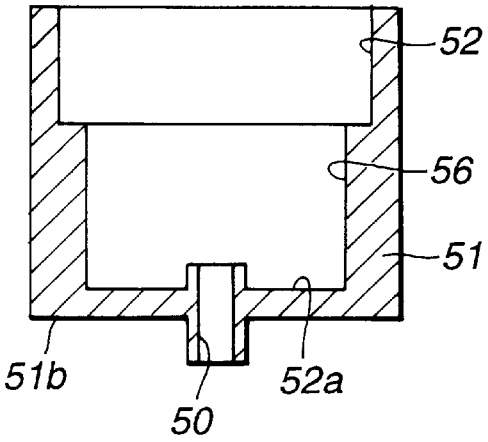
FIGS. 22*a* shows a cross-sectional view showing a first tank of the printer device embodying the present invention and FIGS. 22*b* and 22*c* show a cross-sectional view and plan view showing a liquid holder, respectively.
Figure 22B:
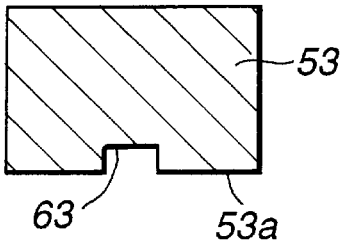
Figure 22C:
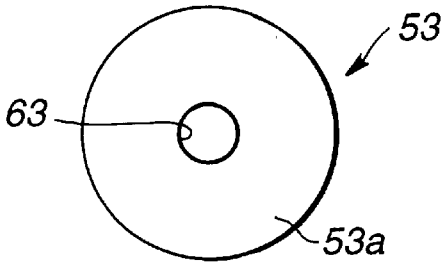

Moreover, in the above-described embodiment, in which the supply port 50 formed in the bottom surface 51*b* of the first tank 51 is protruded towards the bottom surface 52*a* of the liquid chamber 52, as shown in FIG. 22*a*, it becomes possible to provide a recess 63 in register with the supply port 50 towards the bottom surface 53*a* of the liquid holder 53, as shown in FIGS. 22*b* and 22*c*, in order to enable the liquid holder 53 to be housed without becoming deformed in the liquid holder container 56 and in order to enable the liquid holder 53 to be housed in stability perpetually in the liquid holder container 56.

Figure 23A:
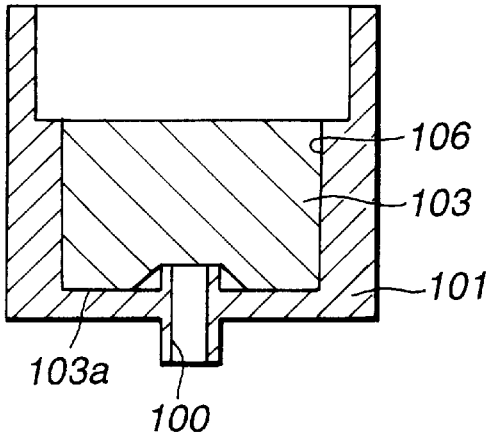
FIGS. 23*a*, 23*b* are cross-sectional views showing a liquid holder of the printer device embodying the present invention and a first tank holding the liquid holder, respectively.
Figure 23B:
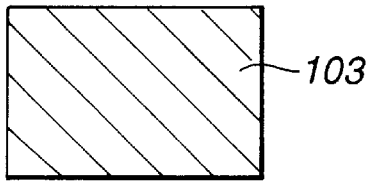

However, the liquid holder need not necessarily be formed in this manner such that the liquid holder may be designed as a rectangular-shaped liquid holder 103, such that, when the liquid holder 103 is housed in the liquid holder container 106, the portion of the liquid holder 103 in register with the supply port 100 of the bottom surface 103*a* is deformed in compression, as shown in FIG. 23*a*. This increases the force of capillary action to facilitate the supply of the quantitation medium and the emission medium in the liquid holder 103 towards the supply port 100.

Figure 24:
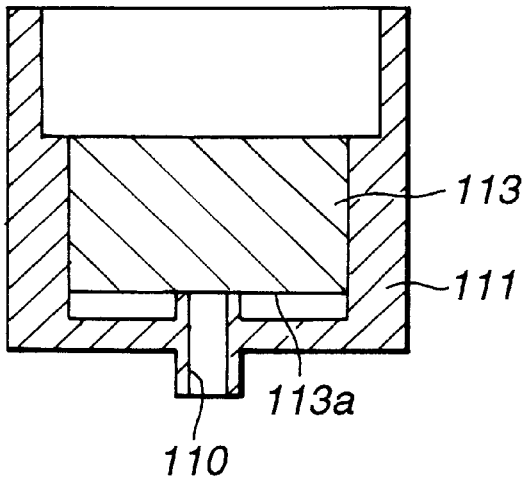
FIG. 24 is a cross-sectional view showing further embodiment of the first tank of the printer device embodying the present invention.

It is also possible to have a bottom surface 113*a* of a rectangular-shaped liquid holder 113 supported by the supply port 110, as shown in FIG. 24. In this case, it is unnecessary to have a recess formed in the liquid holder 113 such that there is no risk of the quantitation medium and the emission medium shall be turned round to the supply port 110 from the lower portion of the liquid holder 113 in an amount exceeding the amount that can be held by the liquid holder 113.

Figure 25:
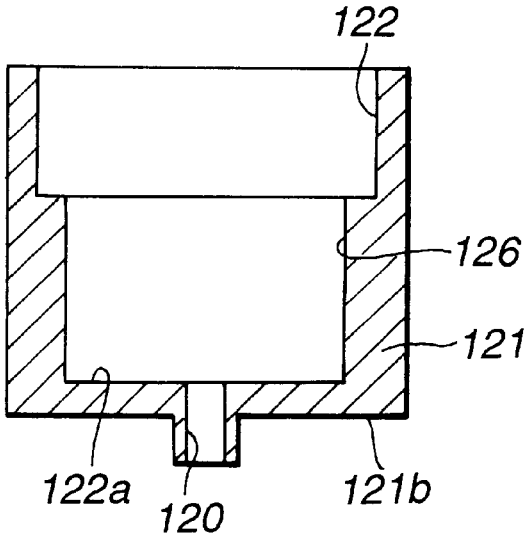
FIG. 25 is a cross-sectional view showing further embodiment of the first tank of the printer device embodying the present invention.
Figure 26:
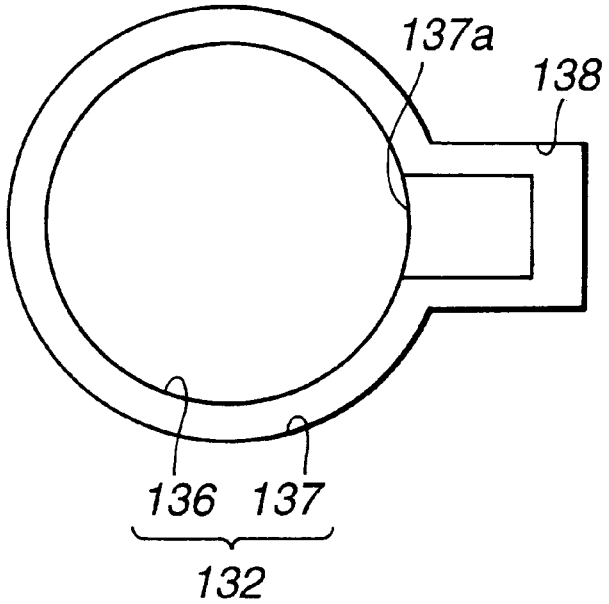
FIG. 26 is a plan view showing further embodiment of the first tank of the printer device embodying the present invention.
Figure 27:
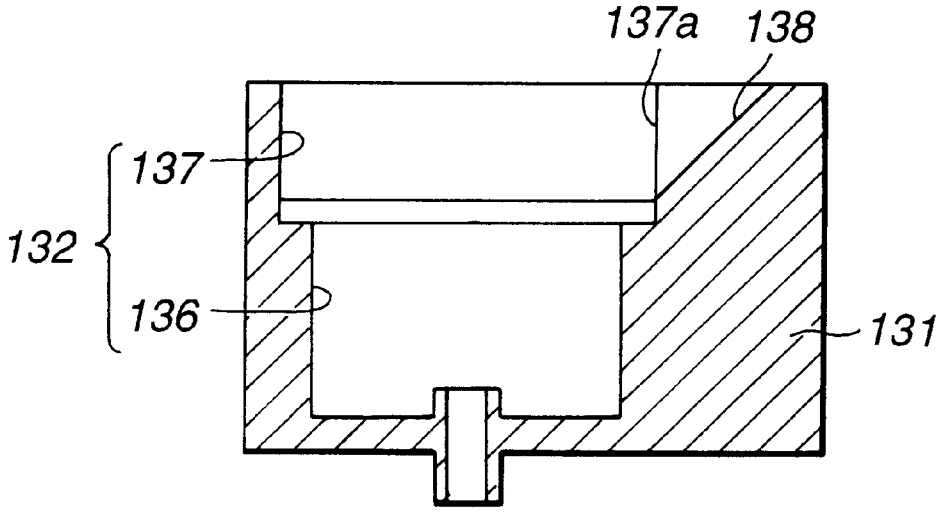
FIG. 27 is a cross-sectional view showing further embodiment of the first tank of the printer device embodying the present invention.

Moreover, if a supply port 120 towards a bottom surface 121*b* of a first tank 121 is not protruded towards a bottom surface 121*b* of the tank 121, as shown in FIG. 25, there is no necessity of machining a recess in the rectangular-shaped liquid holder such that the liquid holder can be held in stability without becoming deformed in the liquid holder container 12.

In the above-described embodiment, the first liquid chamber is made up of the cylindrically-shaped liquid holder container 56 of a smaller size and a quadrilaterally-shaped liquid receiver 57 of a larger size, as shown in FIG. 10. Alternatively, a slope 138 may be formed in a lateral surface 137*a* of a liquid receiver 137 making up the first liquid chamber 132 of the first tank 137 along with the liquid receiver 137 and adapted for being supplied with the quantitation medium and the emission medium from the second liquid chamber of the second tank so that the first liquid chamber is fed with the quantitation medium and the emission medium via this slope 138 from the second liquid chamber of the second tank.

Figure 28:
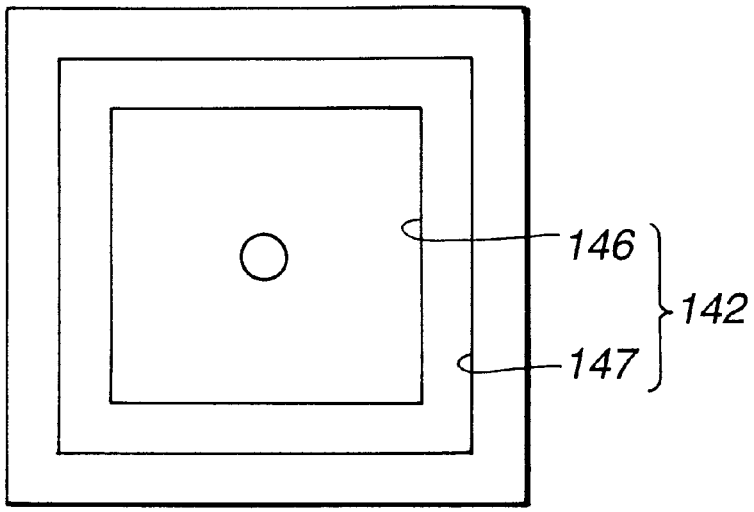
FIG. 28 is a plan view showing further embodiment of the first tank of the printer device embodying the present invention.
Figure 29:
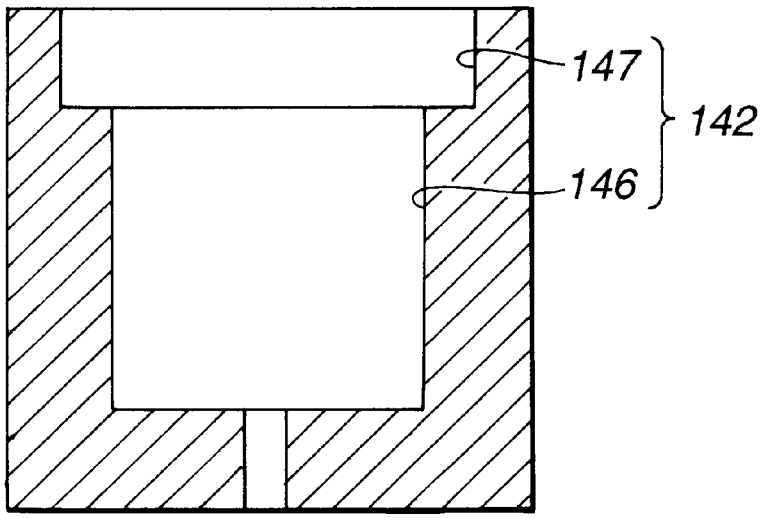
FIG. 29 is a cross-sectional view showing further embodiment of the first tank of the printer device embodying the present invention.

In the above-described embodiment, a subsequently cylindrically-shaped chamber is illustrated as the first liquid chamber of the first tank. Alternatively, this first liquid chamber may be comprised of a liquid holder container 146 of a smaller areal measure with a square planar shape and a liquid receiver 147 of a larger areal measure with a square planar shape arranged on top of the liquid holder container 146, as shown in FIGS. 28 and 29.

Figure 30:
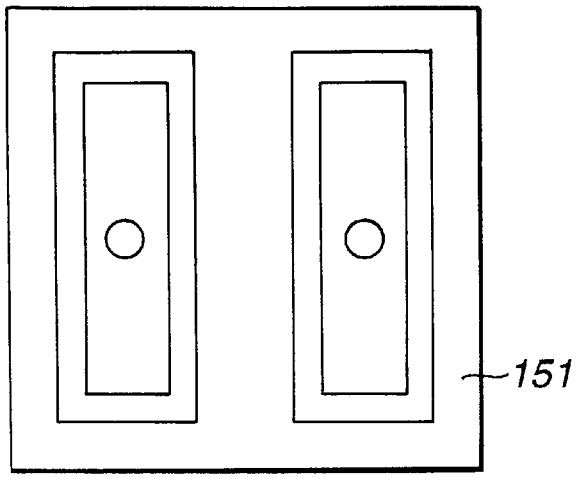
FIG. 30 is a plan view showing further embodiment of the first tank of the printer device embodying the present invention.
Figure 31:
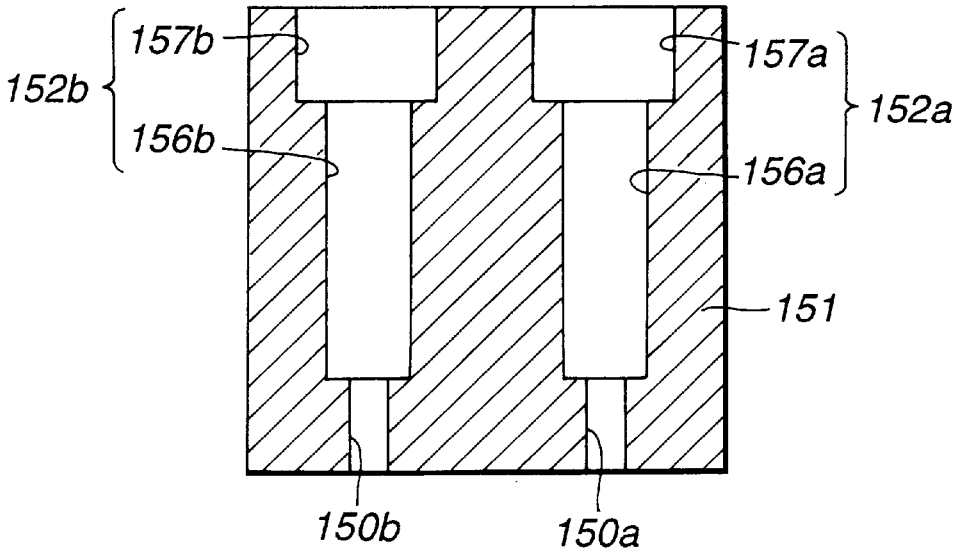
FIG. 31 is a cross-sectional view showing further embodiment of the first tank of the printer device embodying the present invention.

In the above-described embodiment, the first tank has a sole liquid chamber. Alternatively, the first tank may be provided with plural first liquid chambers. Specifically, as shown in FIGS. 30 and 31, a first tank 151 may be provided with a first liquid chamber 152*a* made up of a liquid holder container 156*a* and a liquid receiver 157*a*, and a second liquid chamber 152*b* similarly made up of a liquid holder container 156*b* and a liquid receiver 157*b*. The liquid holder container 156*a* is quadrilaterally-shaped in plan configuration and smaller in planar size, while the liquid receiver 157*a* is quadrilaterally-shaped in plan configuration and larger in planar size. The bottom surface of the first liquid chamber 152*a* is formed with a supply port 150*a*, while the bottom surface of the first liquid chamber 152*b* is also formed with a supply port 150b.

These first liquid chambers 152*a*, 152*b* may be connected to the quantitation medium pressurizing chamber and emission medium pressurizing chamber of each nozzle group. The first liquid chambers 152*a*, 152*b* may also be provided with filters, plates or lids, if so desired.

If the first tank has plural liquid chambers in this manner, the second tank having a sole second liquid chamber is used and provided for each liquid chamber of the first tank. Alternatively, a second tank having plural second liquid chambers may be used, in which case each second liquid chamber of the second tank may be arranged in association with each liquid chamber of the first tank.

Figure 32:
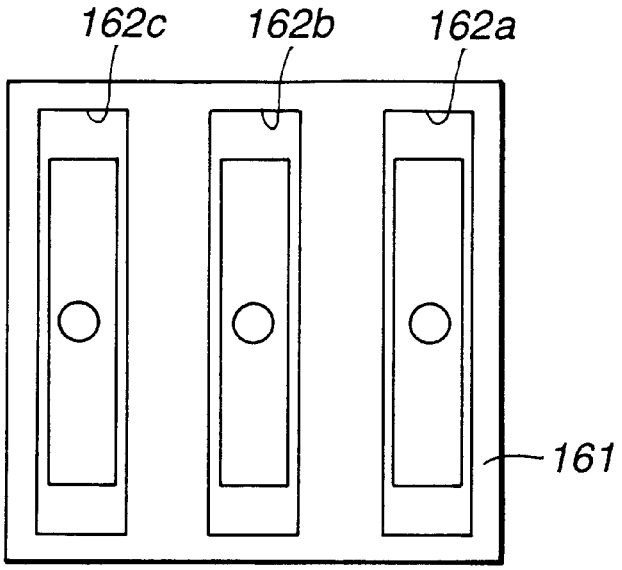
FIG. 32 is a plan view showing further embodiment of the first tank of the printer device embodying the present invention.
Figure 33:
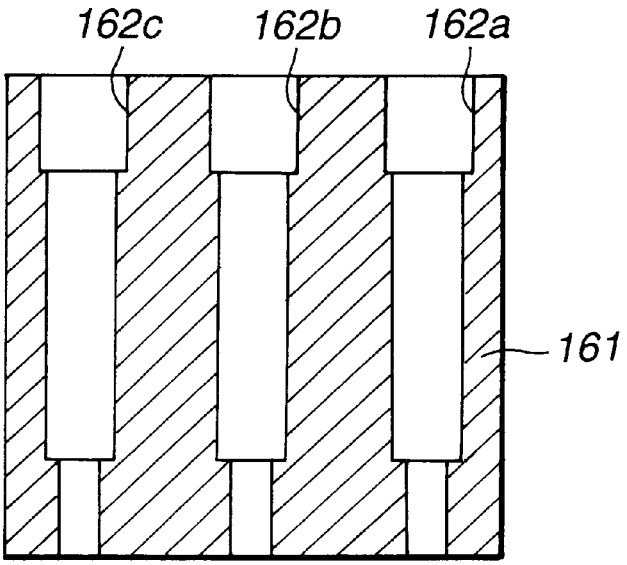
FIG. 33 is a cross-sectional view showing further embodiment of the first tank of the printer device embodying the present invention.
Figure 34:
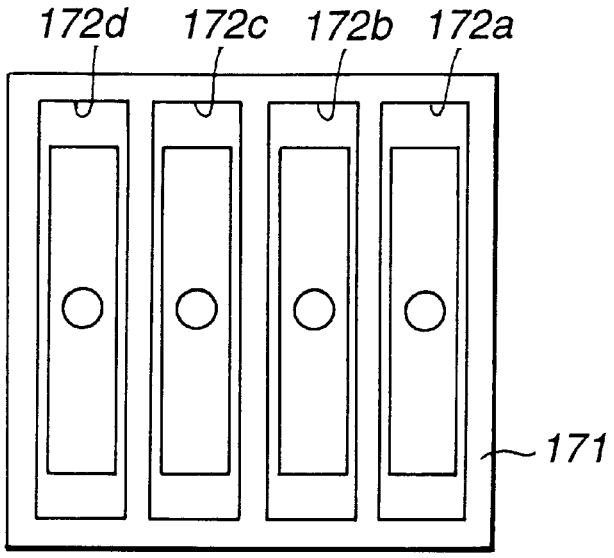
FIG. 34 is a plan view showing further embodiment of the first tank of the printer device embodying the present invention.
Figure 35:
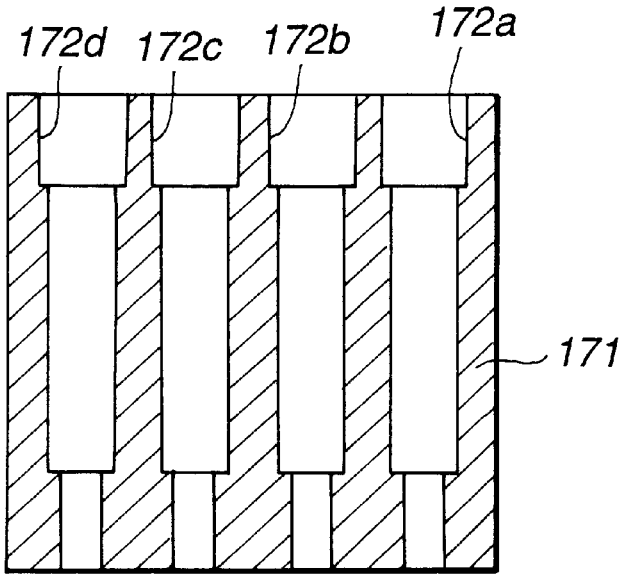
FIG. 35 is a cross-sectional view showing further embodiment of the first tank of the printer device embodying the present invention.

As the first tank, no only the above-described first tank having two first liquid chambers, but also first tanks having plural first liquid chambers, such as a first tank 161 having three first liquid chambers 162*a*, 162*b* and 162*c* of similar shape as shown in FIGS. 32 and 33 or a first tank 171, having four first liquid chambers 172*a*, 172*b*, 172*c* and 172*d* of similar shape as shown in FIGS. 34 and 35, may be used. In these first tanks 161, 171, the liquid chambers may be connected to the quantitation medium pressurizing chambers and emission medium pressurizing chambers of the respective nozzle sets.

The first tank may also be provided with plural liquid chambers one of which may be used for the emission medium and another of which may be used for the quantitation medium. It is also possible to provide plural first tanks, one of which is used for the emission medium and another of which is used for the quantization medium.

The method of supplying the quantitation medium or the emission medium from the second liquid chamber of the second tank to the first liquid chamber of the first tank is hereinafter explained. That is, in the present embodiment of the printer device, the second tank 8 is secured to a casing, not shown, as shown schematically in FIG. 36, while the printer head unit 3 is movable by the belt 7 as indicated by arrow M in FIG. 36. The second tank 8 is provided above the head unit 3.

Figure 36:
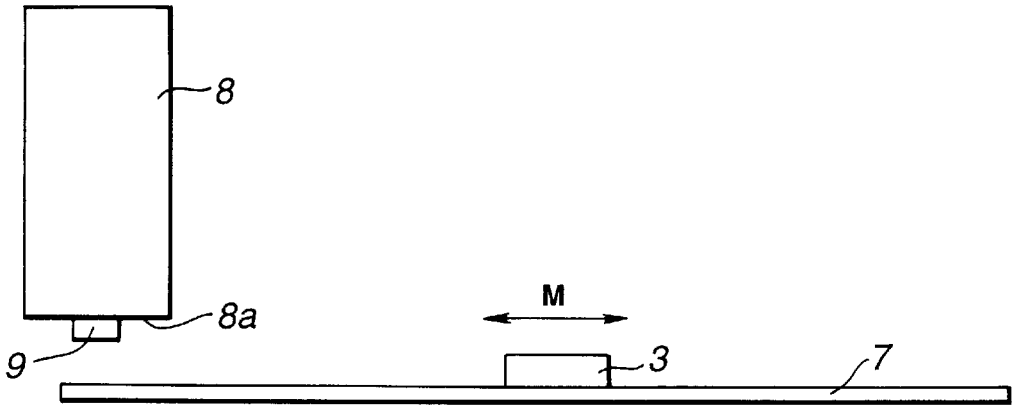
FIG. 36 is a schematic side view showing the relative positions of the printer head and the second tank of the printer device embodying the present invention.
Figure 37:
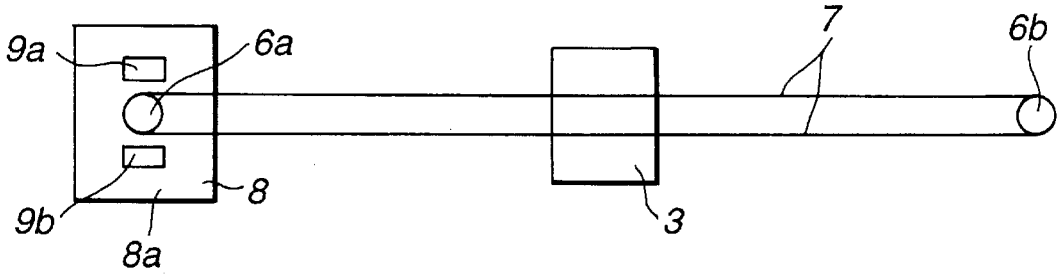
FIG. 37 is schematic side view showing the relative positions of the printer head and the second tank of the printer device embodying the present invention.

Thus, a supply port 9 for supplying the quantitation medium or the emission medium from the second liquid chamber is provided in a major surface 8*a* of the second tank 8, as shown in FIG. 36. Specifically, as shown in FIG. 37, which is a schematic plan view looking from the bottom side, a supply port 9*a* for supplying the emission medium and a supply port 9*b* for supplying the emission medium are formed in a major surface 8*a* which is the bottom surface of the second tank 8. These supply ports 9*a*, 9*b* are formed in association with the liquid receivers of the first tank of the printer head unit 3, not shown.

Figure 38:
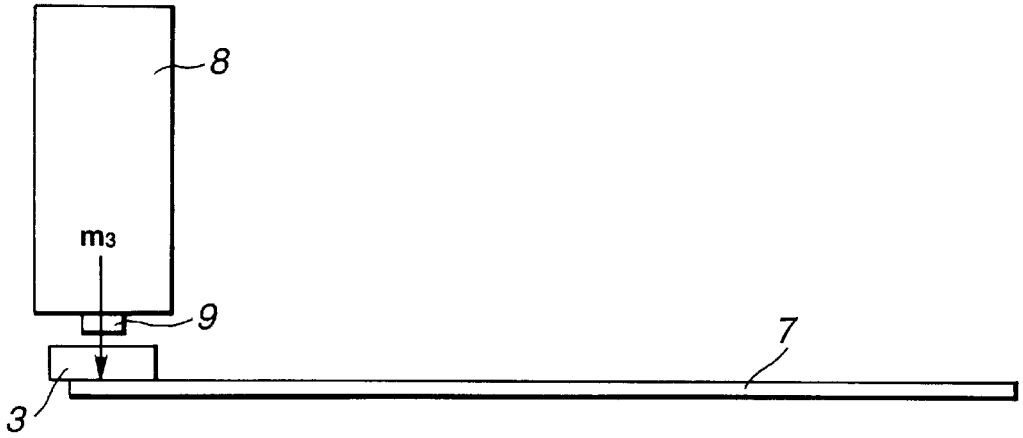
FIG. 38 is a schematic side view showing the manner of supplying the quantitation medium or the emission medium from the first tank to the first tank in the printer device embodying the present invention.

It suffices if, when the printer head unit 3 is moved to a position beneath the second tank 8, as shown in FIG. 38, the quantitation medium or the emission medium is supplied, as indicated by arrow $m_3$, from the supply port 9*a* to the liquid receiver of the first liquid chamber of the printer head unit 3, not shown.

Here, the ink used as the quantitation medium is of the same color. The inks extruded from the quantitation medium nozzles may, however, be of different colors. That is, if the inks charged into the respective liquid chambers for the quantitation medium of the first tank are of different colors, multi-color printing becomes possible. For such multi-color printing, any of the above-mentioned combinations of the first tanks or the second tanks may be used.

Although the foregoing description has been made with reference to an instance of mixing the quantitation medium and the emission medium directly before emission, it is to be noted that the present invention may be applied to a printer device in which the quantitation medium and the emission medium are emitted and mixed directly before deposition on the recording material, or to a printer device in which the quantitation medium and the emission medium are mixed on the recording material.

Although the ink and the dilution liquid are used as the quantitation medium and as the emission medium, respectively, it is of course possible to use the dilution liquid and the ink as the quantitation medium and as the emission medium, respectively.

If both the quantitation medium and the emission medium are inks of different colors, it becomes possible to obtain a dot formed by mixed inks.

Also, the quantitation medium and the emission medium may be inks of the same color but different concentrations.

Specifically, with the present embodiment of the printer device, having a printer head including at least one first tank provided with at least one first liquid chamber containing a liquid holder, and a nozzle in association with the first liquid chamber of the first tank, and at least one second tank including at least one second liquid chamber in association wit the first liquid chamber, with the printer head and the first tank being moved on a recording surface of the recording material for doing recording and the liquid holder in the first tank containing and holding the quantitation medium or the emission medium therein, the quantitation medium or the emission medium can be stably held without regard to the quantities thereof when the first tank contacted with the printer head is moved with the printer head. This suppresses fluctuations in the quantitation medium or the emission medium charged into the quantitation medium nozzle or the emission medium nozzle or fluctuations in the meniscus at the distal end of the nozzle or in the amounts of the mediums for assuring formation of dots of pre-set concentrations and of correct recording images.

Also, the printer device of the present embodiment has at least one second tank having a second liquid chamber in association with the first liquid chamber of the first ink, as described above, such that, if the first tank is of a smaller capacity and the second tank is of a larger capacity, driving means of a smaller driving power than heretofore is sufficient even if the first tank is moved along with the printer head. Thus, a smaller driving power than that hitherto required suffices, while the running cost may also be lowered.

Since the first tank and the printer head are lighter on weight, the first tank moved on the recording surface can be easily brought into registration with the printer head thus assuring registration accuracy and generation of a correct recording image.

The quantitation medium or the emission medium can be replenished in the second tank such that there is no necessity of dismounting the first tank connected to the printer head. Thus, there is no risk of air bubbles being formed in the first liquid chamber of the first tank or the nozzle emission stability being lowered thus assuring the formation of a correct recording image.

If sensor means is provided in the first liquid chamber for detecting the quantity of the liquid held in the liquid holder, and if the liquid is adapted to be supplied from the second liquid chamber when the quantity of the liquid is found to be smaller than a pre-set amount, there is no risk of the liquid overflow from the liquid holder in the first liquid chamber.

The first liquid chamber of the first tank is directly connected to the second liquid chamber of the associated second tank. Stated differently, the first liquid chamber is not directly connected to the second liquid chamber, and the liquid can be charged from the second liquid chamber into the first liquid chamber without interposition of another member. Thus, there is no necessity of interconnecting the first liquid chamber and the second liquid chamber by a tube, such that air bubbles are less liable to n formed, while the meniscus at the distal ends of the nozzle is less liable to fluctuate to assure the formation of a correct recording image.

Moreover, if, in the present embodiment of the printer device, the printer head is formed as one with the first tank, there is no necessity of interconnecting the first liquid chamber and the second liquid chamber by a tube such that air bubbles are less liable to n formed, while the meniscus at the distal ends of the nozzle is less liable to fluctuate to assure the formation of a correct recording image.

Although the foregoing description has been made with reference to a printer device in which the quantitation medium and the emission medium are mixed and emitted as a mixture, the present invention may also be applied to a printer device adapted for emitting only the emission medium.

Specifically, it suffices in such case to provide one or more first tank movable with the printer head and having a first liquid chamber in association with the emission medium pressurizing chamber and one or more second tank having a second liquid chamber in association with the first liquid chamber of the first tank, and to connect the first tank directly to the second tank, in other words, to provide for charging of the liquid from the second liquid chamber into the first liquid chamber without interposition of another member without mechanically interconnecting the first and second liquid chambers.

The first and second liquid tanks can be modified in the same manner as in the case of the printer device adapted for mixing and emitting the quantitation medium and the emission medium.

Specifically, with the present embodiment of the printer device, having a print head having at least one first tank having at least one first liquid chamber containing a liquid holder, and a nozzle in association with the first liquid chamber of the first tank, and at least one second tank having at least one second liquid chamber in association with the first liquid chamber, with the printer head and the first tank being moved on a recording surface of the recording material for doing recording and the liquid holder in the first tank containing and holding the emission medium therein, the emission medium can be stably held without regard to the quantities thereof when the first tank contacted with the printer head is moved with the printer head, thus suppressing fluctuations in the emission medium charged into the emission medium nozzle or fluctuations in the meniscus at the distal end of the nozzle or in the amounts of the mediums for assuring formation of dots of pre-set concentrations and correct recording images.

Also, the printer device of the present embodiment has at least one second tank having a second liquid chamber in association with the first liquid chamber of the first ink, as described above, such that, if the first tank is of a smaller capacity and the second tank is of a larger capacity, driving means of a smaller driving power than heretofore is sufficient even if the first tank is moved along with the printer head. Thus, a smaller driving power than that hitherto required suffices, while the running cost may also be lowered.

Since the first tank and the printer head are lighter on weight, the first tank moved on the recording surface can be easily brought into registration with the printer head thus assuring registration accuracy and generation of a correct recording image.

The emission medium can be replenished in the second tank such that there is no necessity of dismounting the first tank connected to the printer head. Thus, there is no risk of air bubbles being formed in the first liquid chamber of the first tank or the nozzle emission stability being lowered thus assuring the formation of a correct recording image.

Therefore, there is no necessity of sucking the distal end of the emission medium nozzle for emitting air bubbles to outside thus suppressing running costs.

If sensor means is provided in the first liquid chamber for detecting the quantity of the liquid held in the liquid holder, and if the liquid is adapted to be supplied from the second liquid chamber when the quantity of the liquid is found to be smaller than a pre-set amount, there is no risk of the liquid overflow from the liquid holder in the first liquid chamber.

The first liquid chamber of the first tank is not directly connected to the second liquid chamber of the associated second tank. Stated differently, the first liquid chamber is not mechanically connected to the second liquid chamber, and the liquid can be charged from the second liquid chamber into the first liquid chamber without interposition of another member. Thus, there is no necessity of interconnecting the first liquid chamber and the second liquid chamber by a tube, such that air bubbles are less liable to n formed, while the meniscus at the distal ends of the nozzle is less liable to fluctuate to assure the formation of a correct recording image.

Moreover, if, in the present embodiment of the printer device, the printer head is formed as one with the first tank, there is no necessity of interconnecting the first liquid chamber and the second liquid chamber by a tube such that air bubbles are less liable to be formed. In addition, the meniscus at the distal ends of the nozzle is less liable to fluctuate to assure the formation of a correct recording image.

What is claimed is:

1. A printer device comprising:

printer head for mixing an ink and a diluting liquid at a time of ejection and having at least a first tank including at least one first liquid chamber having a liquid holder arranged therein and a nozzle communicating with said first liquid chamber; and a second tank having at least a second liquid chamber in association with said first liquid chamber;

said printer head being moved on a recording surface of the recording material for doing recording.

2. The printer device as claimed in claim 1 wherein an emission medium is charged into said first liquid chamber so that the emission medium is emitted via the nozzle.

3. The printer device as claimed in claim 2 wherein said emission medium is ink.

4. The printer device as claimed in claim 3 wherein the number of said first liquid chamber is one.

5. The printer device as claimed in claim 3 wherein the number of said first liquid chambers is plural and inks of different colors are charged into the first liquid chambers.

6. The printer device as claimed in claim 1 wherein a first liquid chamber charged with a quantitation medium and a first liquid chamber charged with an emission medium are provided as said first liquid chambers and wherein said quantitation medium is mixed and emitted with said emission medium.

7. The printer device as claimed in claim 6 wherein said quantitation medium is ink and said emission medium is a dilution liquid.

8. The printer device as claimed in claim 7 wherein plural first liquid chambers charged with the quantitation medium are provided and are charged with inks of respective different colors.

9. The printer device as claimed in claim 1 wherein there are plural first tanks and there are provided first tanks charged with the quantitation medium and first tanks charged with the emission medium.

10. The printer device as claimed in claim 9 wherein said quantitation medium is ink and said emission medium is a dilution liquid.

11. The printer device as claimed in claim 10 wherein there are plural first liquid chambers and wherein inks of respective different colors are charged into the first liquid chambers.

12. The printer device as claimed in claim 1 wherein sensor means is provided for detecting the quantity of the liquid held in the liquid holder and wherein, if the liquid quantity is detected to be smaller than a pre-set value, the liquid is supplied from said second liquid chamber to said first liquid chamber.

13. The printer device as claimed in claim 1 wherein the first liquid chamber is directly connected to the second liquid chamber when the liquid is supplied from said second liquid chamber to said first liquid chamber.

14. The printer device as claimed in claim 1 wherein an emission medium is charged into the second liquid chamber and is emitted via a nozzle.

15. The printer device as claimed in claim 14 wherein the emission medium is ink.

16. The printer device as claimed in claim 15 wherein there is provided one second liquid chamber.

17. The printer device as claimed in claim 15 wherein there are provided plural second liquid chambers and wherein inks of respective different colors are charged into the second liquid chambers.

18. The printer device as claimed in claim 1 wherein, as said second liquid chambers, second liquid chambers charged with the quantitation medium and second liquid chambers charged with the emission medium are provided and wherein the quantitation medium is mixed and emitted with the emission medium.

19. The printer device as claimed in claim 18 wherein said quantitation medium is ink and said emission medium is a dilution liquid.

20. The printer device as claimed in claim 19 wherein plural first liquid chambers charged with the quantitation medium are provided and are charged with inks of respective different colors.

21. The printer device as claimed in claim 1 wherein there are provided plural second liquid chambers and wherein there are provided second tanks charged with the quantitation medium and second tanks charged with the emission medium.

22. The printer device as claimed in claim 21 wherein said quantitation medium is ink and said emission medium is a dilution liquid.

23. The printer device as claimed in claim 22 wherein there are provided plural second liquid chambers and wherein inks of respective different colors are charged into the second liquid chambers.

24. The printer device as claimed in claim 1 wherein said printer head is molded as one with the first tank.

25. A printer device comprising:

a printer head having a first nozzle into which is introduced a quantitation medium and a second nozzle into which is introduced an emission medium, said printer head being moved on a recording surface of a recording material, said printer head mixing said quantitation medium and said emission medium at a time of ejection;

a first tank having a first liquid chamber communicating with said first nozzle and a first liquid chamber communicating with said second nozzle, said first tank being moved along with said printer head on the recording surface of said recording material; and a second tank provided on a non-recording area of said recording material and having a second liquid chamber in association with the first liquid chamber for communicating with said first nozzle and second liquid chamber in association with the first liquid chamber for communicating with said first nozzle and a second liquid chamber in association with the first liquid chamber for communicating with said second nozzle, said second tank causing said first tank to be moved when the quantity of the quantitation medium or the emission medium in said first liquid chamber falls below pre-set value for charging the quantitation medium or the emission medium from said second liquid chamber to said first liquid chamber.

* * * * *

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 1,

Lines 5-6, replace "This" with -- The present -- and replace "a" (second occurrence) with -- an emission --;
Line 6, delete "for emission" after "medium" and add -- for -- before "mixing" and replace "a" after "emitting" with -- an emission --;
Lines 6-7, delete "for quantitation";
Line 7, insert -- quantitative -- before "medium" and delete "for emission" after "medium".
Line 8, add -- that is -- before "charged" and add -- emission -- after "the";
Line 9, delete "for emission" and add -- quantitative -- before "medium" and delete "for quantitation";
Line 10, add -- parts -- after "two" and replace "suppressing" with -- reducing -- after "for" and replace "running" with -- operating -- before "cost";
Lines 10-11, replace "for enabling" with -- and to enable --;
Line 14, insert -- top -- after "desk" and replace "an" with -- the --;
Line 15, replace "raised" with -- made --;
Line 18, replace "therewith," with -- with this demand, -- and delete "natural";
Line 19, delete "image" after "high quality" and add -- image -- after "printed" and replace "regeneration" with -- generation --;
Line 20, add -- image -- after "tone".
Line 21, delete "a";
Line 22, replace "device" with -- devices -- and replace "emits" with -- emit -- and delete "only when required";
Lines 23-24, replace "such as films," with -- such as a film or paper --;
Line 25, replace "it can be" with -- they have been --;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 1 cont'd,
Line 27, replace "device" (second occurrence) with -- method --;
Line 29, delete "a" after "applies";
Line 30, replace "for emitting" with -- so as to emit --;
Line 32, replace "for pressurizing" with -- which pressurizes -- and replace "emitting" with -- emits --;
Line 34, add -- image -- after "half-tone";
Lines 41-42, replace "ink becomes" with -- printer is -- and replace "be emitted" with -- eject the ink --;
Line 45, replace "the" with -- only a small -- before "number";
Line 46, delete "is only small" after "represented";
Line 49, insert -- half tone -- before "method";
Line 54, insert -- half tone -- after "second";
Line 55, insert -- half tone -- after "first";
Line 65, delete "the" before "printer";
Line 66, replace "such" with -- provided --.

Column 2,
Lines 1 and 2, replace "quantitation" with -- quantitative --;
Line 3, insert -- the quantitative medium nozzle -- before "opening" and replace "in adjacency" with -- being adjacent -- after "opening"
Line 3-4, after "nozzle," delete ", in which a" and replace with -- A --;
Lines 4-5, replace "quantitation" with -- quantitative --;
Line 8, replace "nozzle, the" with -- nozzle. The --;
Line 9, insert -- which has -- before "mixed";
Line 10, replace "quantitation" with -- quantitative -- and replace "for" with -- which results in --;
Lines 10-11, replace "quantitation" with -- quantitative --;
Line 12, replace "quantitation" with -- quantitative --;
Line 13, after "the" insert -- quantity of the -- and replace "quantitation" with -- quantitative --;

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 2 cont'd,
Line 14, insert -- either -- before "the ink";
Line 17, replace "Meanwhile, one of" with -- Either -- and replace "quantitation" with -- quantitative --;
Line 18, replace "and" with -- or -- and insert -- used for -- before "the ink";
Line 19, replace "outer" with -- other -- and insert -- used for -- after "being";
Line 20, replace "on" with -- over --;
Line 24, insert -- for -- before "mixing";
Lines 25, 28 and 29, replace "quantitation" with -- quantitative --;
Line 31, delete "adapted for being";
Line 32, replace "on" with -- over --;
Line 34, replace "fixedly" with -- in a fixed position --, and insert -- is -- after "and", and insert -- a -- after "by";
Line 36, replace "on" with -- over --;
Line 37, replace "former method" with -- construction with the tank mounted on the printer head --;
Line 38, replace "quantitation" with -- quantitative -- and replace "a" with -- the --;
Line 40, insert -- the printer head -- before "driving";
Line 41, insert -- which is -- before "adapted";
Line 42, replace "on" with -- over -- and replace "surface, such that the" with -- surface. The --;
Line 44, delete "running";
Line 47, replace "each other" with -- a desired printing location --;
Line 48, replace "on" with -- over --;
Line 51, replace "quantitation" with -- quantitative --;
Line 52, replace "excessive" with -- large --;
Lines 53 and 54, replace "quantitation" with -- quantitative --;
Line 56, insert -- pressure -- after "undergo";
Line 57, replace "quantitation" with -- quantitative --;
Line 58, replace "to render" with -- which renders -- and delete "the" before "dots";
Line 61, replace "shall" with -- may --;
Line 62, replace "quantitation" with -- quantitative --;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 2 cont'd,
Line 62, replace "distal" with -- open --;
Line 64, replace "quantitation" with -- quantitative --,
Line 65, replace "to render" with -- which renders --;
Line 66, replace "of" (second occurrence) with -- or --.

Column 3,
Lines 1 and 3, replace "quantitation" with -- quantitative --;
Line 3, replace "is oscillated" with -- oscillates --;
Line 5, replace "to" with -- which --, insert -- the -- before "supply", and replace "quantitation" with -- quantitative --;
Line 6, replace "to detract" with -- that detracts --;
Line 7, replace "to render" with -- and renders --;
Line 10, replace "by a laborious" with -- which is a burdensome --;
Line 11, replace "quantitation" with -- quantitative --;
Line 12, replace "supplemented" with -- filled -- and insert -- a -- before "tank";
Line 13, replace "shall" with -- will --;
Line 14, replace "at" with -- during --;
Line 15, insert -- removal and -- before "attachment", insert -- . -- after "attachment", and delete "and removal";
Lines 15-16, delete "be intruded" and insert -- intrude --;
Line 16, insert -- so as -- after "chambers" and insert -- the -- before "supply";
Lines 17-18 (two occurrences), replace "quantitation" with -- quantitative --;
Lines 18-19, replace "to detract" with -- which detracts --;
Line 19, insert -- the -- after "from" and replace "to render" with -- and renders --;
Line 20, replace "correct" with -- correctly --;
Line 21, replace "inconvenience" with -- problem --;
Line 22, replace "sucking" with -- applying a vacuum to -- and replace "distal" with -- open --;
Lines 22 and 24, replace "quantitation" with -- quantitative --;
Line 23, replace "for emitting" with -- to remove --;

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 3 cont'd,
Lines 23-24, delete "to outside";
Line 25, replace "sucked" with -- is removed -- and replace "are" with -- and is -- and add -- leading -- after "wasted";
Line 26, replace "running" with -- operating --;
Line 27, delete "for" and delete "to" (second occurrence);
Line 28, replace "interconnect" with -- interconnects to -- and delete "and the tank" after "head";
Line 29, replace "moved" with -- that moves --;
Line 34, replace "the present" with -- such -- and insert -- air passes through -- before "the tube";
Lines 34-35, delete "is passed through by air";
Line 36, replace "intruded" with -- intrude --;
Line 37, replace "inconvenience" with -- described problems -- and replace "whirled" with -- flexed --;
Line 38, insert -- up -- before "with" and insert -- the -- before "movement";
Lines 39, 41, 42, 45, 52 and 53, replace "quantitation" with -- quantitative --,
Line 42, insert -- which is -- before "charged";
Line 43, replace "distal" with -- open --;
Lines 45-46, replace "to render" with -- which renders --;
Line 46, replace "of" (second occurrence) with -- or --;
Line 49, replace "fall into disorder" with -- become deformed or entangled --;
Line 51, replace "to increase" with -- which increases -- and replace "mixing" with -- being mixed --;
Line 61, replace "running" with -- operating --;
Lines 61-62, replace "suppressed to" with -- reduced and still --.

Column 4,
Line 2, replace "on" with -- over --;
Lines 4 and 6, replace "quantization" with -- quantitative --;
Line 11, replace "quantitation" with -- quantitative --;
Line 13, replace "on" with -- over --;
Line 14, delete "," after "material" and insert -- . The printer has -- and replace "first" (second occurrence) with -- quantitative --;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 4 cont'd,
Line 15, replace "a first" with -- an emission --;
Line 17, replace "on" with -- over --;
Line 19, replace "on" with -- over --;
Line 20, replace "first" with -- quantitative --;
Line 21, replace "second" with -- first --;
Line 22, replace "first" with -- emission --;
Lines 23-24, replace "The second tank" with -- A control circuit --;
Line 24, insert -- to the second tank -- after "moved";
Lines 25 and 27, replace "quantitation" with -- quantitative --;
Line 26, delete "first" and replace "chamber" with -- chambers of the first tank --;
Line 26, delete "for" and insert -- so that --
Line 28, insert -- tank -- after "first" and insert -- can be performed -- after "chamber" and before ".";
Line 31, replace "in stability" with -- stable -- and replace "amounts" with -- amount --;
Lines 32, 33, 34 and 37, replace "quantitation" with -- quantitative --;
Lines 32-33, delete "for suppressing" and replace with -- so as to suppress --;
Line 36, delete "distal" and add -- open --;
Line 47, delete "heretofore" and insert -- previously possible --;
Line 48, after "Therefore," insert -- a --;
Lines 49-50, delete "suppress the running cost" and insert -- drive the print head and so reduces the costs -- before ".";
Line 52, after "registration" delete "between" and insert -- of -- and after "components" insert -- with a desired printing location --;
Line 53, delete "on" and replace with -- over --;
Line 56, replace "quantitation" with -- quantitative --;
Line 64, delete "holder in the liquid" before "chamber";

Column 5,
Line 3, delete "liquid holder in the" before "first";
Lines 5-6, delete "second liquid chamber of the second tank, associated therewith" and replace with -- print nozzle --;
Line 7, delete "as-one" and replace with -- as a single unit --;
Line 10, delete "while" and replace with -- since -- and delete "distal" and replace with -- open --;
Line 30, replace alphabets in "FIGS. 7a, 7b and 7c" with capital letters "A", "B", or "C" (as appropriate) instead of small letters;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Line 33, replaces alphabets in "FIGS. 8a and 8b" with capital letters "A" or "B" (as appropriate) instead of small letters;
Lines 34 and 35, replace "quantitation" with -- quantitative --;

Column 6,
Line 11, replace "22a" with -- 22A --;
Line 13, replace "22b and 22c" with -- 22B and 22C --;
Line 15, replace "23a, 23b" with -- 23A and 23B --;
Lines 18, 21, 24, 27, 30, 33, 36, 39, 42, 45, 48 and 51, after "showing" and before "further", insert -- a --;

Column 7,
Lines 2 and 49, replace "quantitation" with -- quantitative --;
Line 15, delete "subsequently";
Lines 56-57, delete "(printer head)";
Line 60, delete "transiently" and replace with -- temporarily --.

Column 8
Lines 21 and 22, delete "reinforcing" and replace "quantitation" with -- quantitative --;
Line 24, delete "exhibiting water-proofness" and add -- which is waterproof -- and change "oil-proofness" to -- oil-proof --;
Line 26, add -- Referring to FIG. 6, -- and change "On" to -- on --;
Lines 26 and 29, replace "quantitation" with -- quantitative --;
Lines 32, 34, 40, 41 and 42, replace "quantitation" with -- quantitative --;
Line 33, replace "quantitating" with -- quantifying --;
Line 36, delete "subsequently";
Line 37, replace "distal" with -- open --;
Lines 42 and 43, replace "quantitated" with -- a quantity of -- and replace "to be oozed out." with -- to ooze out. --
Lines 44, 45, 47, 50 and 51, replace "quantitation" with -- quantitative --;
Line 49, before "narrow" add -- a -- and replace "plays" with -- performs --;
Line 54, delete "subsequently";

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 55 cont'd,
Line 55, replace "quantitation" with -- quantitative --;
Line 60, before "narrow" add -- a --.

Column 9,
Lines 1 and 2, replace "quantitation" with -- quantitative --;
Line 7, after "Since the", add -- liquids ejected from the quantitative -- and delete "quantitation";
Line 11, replace "quantitation" with -- quantitative --;
Lines 17 and 18, after "selected" replace "in meeting" with -- to meet -- and replace "quantitation" with -- quantitative --;
Line 19, after "but" add -- may be -- and replace "in areal measure" with -- in areas. --
Lines 20, 25 (two occurrences), 27, 31, 32 and 34, replace "quantitation" with -- quantitative --;
Line 33, replace "Switch" with -- switch --;
Lines 37, 40, 44 and 47, replace "quantitation" with -- quantitative --;
Lines 39 and 42, replace "sole" with -- single --;
Line 51, replace "quantitation" with -- quantitative --;
Lines 55 and 56, delete "via" and add -- between which is -- and delete "in-between";
Lines 61 and 62, replace "quantitation" with -- quantitative --;
Line 68, replace "quantitating" with -- quantifying -- and replace "quantitation" with -- quantitative --;

Column 10,
Lines 1, 4, 6, 8 and 9-10, replace "quantitation" with -- quantitative --;
Line 4, replace "register" with -- registration --;
Line 18, replace "quantitation" with -- quantitative --;
Line 24, insert -- for -- before "thrusting";
Lines 27-28, 31, 33, 34-35 and 38-39, replace "quantitation" with -- quantitative --;
Line 33, replace "register" with -- registration --;
Line 34, replace "quantitated" with -- quantified --;
Line 35, change "to be oozed" to -- to ooze --;
Line 41, delete "to" after "approaches";
Lines 42 and 43, delete the phrase "To the piezoelectric device 32, provided in association with the emission medium pressurizing chamber 35,";

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 10 cont'd,
Line 44, change "rectangular-shaped" to -- Rectangular-shaped --;
Line 45, change "quantitated" to -- quantified --;
Line 47, change "by" to -- of --;
Line 50, replace "quantitation" with -- quantitative --;
After line 60 in Table, delete "Ink Composition" on line 1 of Table, and delete "C.I. Direct Yellow 87" from line 2 of Table;

Column 11,
In Table, (typed) line 2, delete "Composition of Dilution Liquid";
Lines 11, 12, 13, 20, 24, 26-27, 30, 32 and 34, replace "quantitation" with -- quantitative --;
Line 25, replace "against" with -- to corrosion by --;
Line 27, replace "against" with -- to --;
Line 37, replace "quantitation" with -- quantitative --;
Line 40, delete "such" and replace "entanglements" with -- clogging --;
Line 41, replace "entangled" with -- clogged --;
Line 46, add -- to corrosion by -- after "against" and replace "quantitation" with -- quantitative --;
Line 55, add -- corrosion by -- before "the (first occurrence) and replace "quantitation" with -- quantitative --;

Column 12,
Line 6, replace "chamber(s)" with -- chamber --;
Line 7, change "quantitation" with -- quantitative --;
Line 13, after "against" insert -- corrosion by -- and replace "quantitation" with -- quantitative --;
Lines 19 and 20, replace "tank(s)" with -- tank --;
Line 23, replace "register" with -- registration --;
Lines 23 and 35, replace "quantitation" with -- quantitative --;
Line 41, replace "This" with -- The second --;
Lines 43, 44, 50 and 55, replace "quantitation" with -- quantitative --;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 13,
Line 2, replace "quantitation" with -- quantitative --;
Line 14, replace "in" with -- on --;
Line 60, after "housed" replace "in stability perpetually" with -- permanently stationary --.

Column 14,
Lines 4 and 19, replace "quantitation" with -- quantitative --;
Lines 19-20, replace "in stability" with -- stationary --;
Lines 29-30 and 32, replace "quantitation" with -- quantitative --;
Lines 39 and 40, replace "areal" with -- area --;
Line 44, replace "sole" with -- single --;
Line 59, replace "quantitation" with -- quantitative --;
Line 64, replace "sole" with -- single --;

Column 15,
Lines 12, 17-18, 21, 30, 43, 47, 48, 51, 56, 59, 62 and 65, replace "quantitation" with -- quantitative --;
Line 20, replace "quantization" with -- quantitative --;

Column 16,
Lines 1, 3, 6, 17, 18, 22, 23 and 43, replace "quantitation" with -- quantitative --;
Line 15, replace "on" with -- over --;
Line 20, replace "contacted with" with -- affixed to --;
Line 39, after "tank" insert -- and print head -- and after "moved" replace "on" with -- over --;
Line 40, replace "printer head" with -- desired print location --;
Line 50, insert -- a -- before "sensor";
Line 64, replace "n" with -- be --;
Line 65, replace "distal" with -- open --;

Column 17,
Line 4, replace "second liquid chamber" with -- nozzles --;
Line 5, "n" with -- be --;
Line 6, replace "distal" with -- open --;

UNITED STATES PATENT AND TRADEMARK OFFICE

CERTIFICATE OF CORRECTION

PATENT NO. : 6,142,597
DATED : November 7, 2000
INVENTOR(S) : Toshiki Kagami

It is certified that error appears in the above-identified patent and that said Letters Patent is hereby corrected as shown below:

Column 17, cont'd,
Line 9, replace "quantitation" with -- quantitative --;
Line 17, replace "tank" with -- tanks --;
Line 36, replace "on" with -- over --;
Line 40, replace "contacted with" with -- fixed to --;
Line 44, replace "distal" with -- open --;
Line 52, insert -- required -- after "heretofore";
Line 57, after "lighter", replace "on" with -- in --;
Line 58, after "tank" insert -- which is -- and replace "on" with -- over --;
Line 59, after "the" replace "printer head" and insert -- desired print location --;

Column 18,
Line 1, replace "sucking the distal" with -- applying a vacuum to the open --;
Line 2, replace "emitting" with -- withdrawing -- and insert -- the -- after "to";
Line 3, replace "suppressing running" with -- reducing operating --
Line 4, insert -- a -- after "If";
Line 18, replace "n" with -- be --;
Line 25, replace "second liquid chamber" with -- nozzles --.

Signed and Sealed this

Thirtieth Day of April, 2002

*Attest:*

*Attesting Officer*

JAMES E. ROGAN
*Director of the United States Patent and Trademark Office*